US010163590B2

(12) United States Patent
Tabata et al.

(10) Patent No.: US 10,163,590 B2
(45) Date of Patent: Dec. 25, 2018

(54) POWER-CIRCUIT BREAKING DEVICE

(71) Applicant: JAPAN AVIATION ELECTRONICS INDUSTRY, LIMITED, Tokyo (JP)

(72) Inventors: Yuya Tabata, Tokyo (JP); Yuichiro Nakamura, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/624,048

(22) Filed: Jun. 15, 2017

(65) Prior Publication Data

US 2017/0365424 A1 Dec. 21, 2017

(30) Foreign Application Priority Data

Jun. 20, 2016 (JP) ..... 2016-121684

(51) Int. Cl.
*H01R 13/62* (2006.01)
*H01H 21/22* (2006.01)
(Continued)

(52) U.S. Cl.
CPC ..... *H01H 21/22* (2013.01); *H01H 21/12* (2013.01); *H01R 13/62938* (2013.01);
(Continued)

(58) Field of Classification Search
CPC ..... H01R 13/635; H01R 13/62938; H01R 13/62933; H01R 13/625
(Continued)

(56) References Cited

U.S. PATENT DOCUMENTS 6,325,648 B1 12/2001 Bilezikjian et al.
7,872,206 B2 * 1/2011 Matsunaga ..... H01H 9/085 200/335
(Continued)

FOREIGN PATENT DOCUMENTS

CN 101454950 A 6/2009
CN 203205621 U 9/2013
(Continued)

OTHER PUBLICATIONS

Office Action issued in Korean family member Patent Appl. No. 10-2017-0076674, dated May 16, 2018, along with an English translation thereof.
(Continued)

*Primary Examiner* — Thanh Tam Le
(74) *Attorney, Agent, or Firm* — Greenblum & Bernstein, P.L.C.

(57) ABSTRACT

A power-circuit breaking device includes a receptacle and a plug. The receptacle includes a power terminal and a signal terminal. The plug includes a main terminal and a sub-terminal. The plug includes a plug housing, a lever which is attached to the plug housing, a lock slider which is attached to the plug housing, and a sub-connector which is supported by the lock slider. The plug housing holds the main terminal. The sub-connector holds the sub-terminal. When the lock slider slides, the sub-connector moves. When the lever is located at a closed position, the main terminal is connected to the power terminal. When the lock slider is located at a connected position, the sub-terminal is connected to the signal terminal.

17 Claims, 17 Drawing Sheets

(51) Int. Cl.

| | |
|---|---|
| ***H01H 21/12*** | (2006.01) |
| ***H01R 13/629*** | (2006.01) |
| ***H01R 13/639*** | (2006.01) |
| ***H01R 13/70*** | (2006.01) |

(52) U.S. Cl.
CPC ..... *H01R 13/639* (2013.01); *H01R 13/701* (2013.01); *H01H 2207/022* (2013.01)

(58) Field of Classification Search
USPC ..... 439/153, 157, 310, 314
See application file for complete search history.

(56) References Cited

U.S. PATENT DOCUMENTS

| | | | | |
|---|---|---|---|---|
| 8,303,320 | B2 * | 11/2012 | Loncar | H01R 13/516 439/157 |
| 8,915,749 | B2 * | 12/2014 | Ikeda | H01R 13/62938 439/157 |
| 9,325,112 | B2 * | 4/2016 | Tabata | H01R 13/62905 |
| 9,484,668 | B2 * | 11/2016 | Kamei | H01R 13/502 |
| 9,893,469 | B2 * | 2/2018 | Tabata | H01R 13/641 |
| 2007/0232100 | A1 | 10/2007 | Tyler | |
| 2011/0117761 | A1 | 5/2011 | Loncar et al. | |
| 2015/0064954 | A1 | 3/2015 | Tabata et al. | |
| 2016/0056573 | A1 | 2/2016 | Kamei et al. | |

FOREIGN PATENT DOCUMENTS

| | | | |
|---|---|---|---|
| CN | 103000431 | B | 6/2015 |
| CN | 105375192 | A | 3/2016 |
| EP | 1947744 | A2 | 7/2008 |
| JP | 2015-050116 | A | 3/2015 |
| WO | WO 2013092174 | A1 | 6/2013 |

OTHER PUBLICATIONS

Office Action issued in Chinese family member Patent Appl. No. 201710457524.7, dated Sep. 27, 2018 , along with an English translation thereof.

* cited by examiner

POWER-CIRCUIT BREAKING DEVICE

TECHNICAL FIELD

The present invention relates to a power-circuit breaking device for breaking a power circuit.

BACKGROUND ART

A power-circuit breaking device is used to, for example, perform the work of maintaining an electrical system. FIG. 1 shows a connector device disclosed in Japanese Patent Application Laid Open No. 2015-50116 as a conventional example of this type of power-circuit breaking device. The connector device relays power supplied from a power system.

The connector device includes a first connector 10 and a second connector 20. The connector device is configured such that the first connector 10 can be fit into the second connector 20 and be removed from the second connector 20. FIG. 2 shows portions constituting the first connector 10. The first connector 10 includes a housing 11, a main terminal (power terminal) 12, a first operation member (lever) 13, a second operation member (slider) 14, a sub-connector 15, and a sub-terminal (sensing terminal) 16.

FIG. 3 shows a state where the first connector 10 is inserted in the second connector 20 and the second operation member 14 is at a second initial position. FIG. 4 shows a state where the first connector 10 is inserted in the second connector 20 and the second operation member 14 is at a second operating position. FIG. 5 shows the cross-sectional structure of the connector device in the state shown in FIG. 4.

The outline of the connector device will be described below.

The second connector 20 includes a housing 21, two main terminals 22, sub-connectors 23, and two sub-terminals 24 (see FIG. 5). The two sub-terminals 24 are held by the sub-connectors 23. The sub-connectors 23 are held by the housing 21. The two main terminals 22 are inserted in holding portions 21*a* of the housing 21 and held by the holding portions 21*a*.

The main terminal 12 of the first connector 10 is inserted in the housing 11 and is held by the housing 11. The first operation member 13 is attached to the housing 11. A support shaft 11*a* of the housing 11 is inserted in a fulcrum portion 13*a* of the first operation member 13. Thus, the first operation member 13 can rotate about the fulcrum portion 13*a* as a pivot. The first operation member 13 moves between a first initial position (the position in FIG. 1) and a first operating position (the position in FIG. 3) through the rotation.

Slide projections 14*a* of the second operation member 14 are inserted in slide grooves 13*b* of the first operation member 13. As described above, the second operation member 14 is supported by the first operation member 13. The second operation member 14 can thus move in a longitudinal direction of the first operation member 13. With sliding of the second operation member 14 relative to the first operation member 13, the second operation member 14 moves between the second initial position and the second operating position.

The sub-terminal 16 is held by a holding portion 15*a* of the sub-connector 15. The sub-connector 15 is inserted in the housing 11 from below the housing 11 and is stored in a storage portion 11*b* of the housing 11. With adoption of a configuration in which the sub-connector 15 can be located both at a first position (upper position) and a second position (lower position) inside the housing 11, the sub-connector 15 is supported by the housing 11.

The first connector 10 is attached to the second connector 20 in the manner below.

A lower end portion of the housing 11 is inserted into the housing 21. When the first operation member 13 is located at the first initial position, a cylindrical cam projecting portion (which is hidden and not shown in FIG. 1) of the housing 21 is located in a cam groove portion 13*c* of the first operation member 13.

Through a rotational operation, the first operation member 13 moves from the first initial position to the first operating position (the position in FIG. 3). At this time, the cam projecting portion moves inside the cam groove portion 13*c*, which causes the housing 11 to move downward (that is, toward the second connector 20) and causes the main terminal 12 to be connected to the main terminals 22. When the main terminal 12 is connected to the main terminals 22, a power circuit (not shown) is formed.

When the second operation member 14 is located at the second initial position, as shown in FIG. 3, a cam projecting portion 15*b* of the sub-connector 15 is located at a front (an upper side in FIG. 2) end portion of a cam groove portion 14*b* of the second operation member 14.

Through a slide operation, the second operation member 14 moves from the second initial position (the position in FIG. 3) to the second operating position (the position in FIG. 4). The cam projecting portion 15*b* moves inside the cam groove portion 14*b*, which causes the sub-connector 15 to move downward (that is, toward the second connector 20). As shown in FIG. 5, with the movement of the sub-connector 15, the sub-terminal 16 is connected to the sub-terminals 24 at the other end. With the connection, a switch of the power circuit (not shown) is closed, and energization starts.

The first connector 10 fit in the second connector 20 is removed from the second connector 20 in the manner below.

When a lock lever 14*c* of the second operation member 14 is pushed downward (that is, toward the second connector 20), the second operation member 14 unlocks. With the unlocking, the second operation member 14 can move from the second operating position to the second initial position. The sub-connector 15 moves from the second position to the first position, the sub-terminal 16 is disconnected from the sub-terminals 24 at the other end, and energization stops.

Through a rotational operation, the first operation member 13 moves to the first initial position. The housing 11 moves upward (that is, in a direction away from the second connector 20), which causes the main terminal 12 to move upward (that is, in the direction away from the second connector 20). Thus, the main terminal 12 is disconnected from the main terminals 22 at the other end, and the power circuit is broken.

As described above, in the example, the main terminal 12 is connected to and disconnected from the main terminals 22 through operation of the first operation member 13, and the sub-terminal 16 is connected to and disconnected from the sub-terminals 24 through operation of the second operation member 14. That is, the first operation member 13 for operating the housing 11 that holds the main terminal 12 is different from the second operation member 14 for operating the sub-connector 15 that holds the sub-terminal 16. For this reason, it is impossible to simultaneously stop energization and break the power circuit. Thus, sufficient time is secured between disconnection of the sub-terminal 16 from the sub-terminals 24 and disconnection of the main terminal 12 from the main terminals 22.

The above-described power-circuit breaking device (connector device) can avoid breaking of a power circuit in an energized state and secure a discharge time between stoppage of energization and breaking of the power circuit. If the power-circuit breaking device (connector device) is installed in an electrical system using a high-capacity power source, arc discharge between terminals can be prevented from occurring at the time of breaking a power circuit in a case where maintenance work or the like is performed, and safety of a worker which performs maintenance work can be secured.

In the power-circuit breaking device having the configuration shown in FIGS. 1 to 5, the second operation member (slider) 14 to be slide-operated is attached to the first operation member (lever) 13 to be operated by a user. With the configuration having the support shaft 11*a* inserted in the fulcrum portion 13*a*, the first operation member 13 is tiltable. Occurrence of looseness of the first operation member 13 is thus inevitable. The looseness of the first operation member 13 may degrade the position accuracy of the second operation member 14.

The degradation of the position accuracy of the second operation member 14 invites degradation of the position accuracy of the sub-connector 15 to be connected to the second operation member 14. Thus, the accuracy of alignment of the sub-terminal 16 held by the sub-connector 15 with the sub-terminals 24 may degrade to create a situation where the sub-terminal 16 held by the sub-connector 15 fails to be satisfactorily connected to the sub-terminals 24.

SUMMARY OF THE INVENTION

In view of the above-described problems, an object of the present invention is to provide a power-circuit breaking device with significant improvement in the accuracy of alignment when a sub-terminal held by one connector and a sub-terminal (signal terminal) held by the other connector are connected.

The power-circuit breaking device includes a receptacle and a plug. The receptacle includes one pair of power terminals and one pair of signal terminals inside a receptacle housing. The plug includes a plug housing, a main terminal, a sub-terminal, a lever, a lock slider, and a sub-connector. The lever is attached to the plug housing. The lever is tiltable in a direction toward the plug housing and in a direction away from the plug housing between an open position and a closed position. The lock slider is attached to the plug housing. The lock slider is slidable along the plug housing between an unconnected position and a connected position when the lever is located at the closed position. The sub-connector is stored in the plug housing while being supported by the lock slider. The sub-connector is movable inside the plug housing. The main terminal is held by the plug housing. The sub-terminal is held by the sub-connector. The plug is insertable into the receptacle and is removable from the receptacle when the lever is located at the open position. The plug enters into the plug housing if the lever tilts in the direction toward the plug housing while the plug is inserted in the receptacle. The lock slider is located at the unconnected position when the lever is not located at the closed position. The sub-connector moves when the lock slider slides. The main terminal is connected to the one pair of power terminals when the plug is inserted in the receptacle, and the lever is located at the closed position. The sub-terminal is connected to the one pair of signal terminals when the lever is located at the closed position, and the lock slider is located at the connected position.

Effects of the Invention

According to the present invention, the lock slider that moves the sub-connector is attached not to the lever to be tilt-operated but to the plug housing. The lock slider is thus not affected by looseness of the lever. This improves the accuracy of alignment of the sub-terminal held by the sub-connector with the one pair of signal terminals attached to the receptacle.

DETAILED DESCRIPTION OF THE EMBODIMENT

An embodiment of this invention will be described with reference to the drawings.

Figure 1:
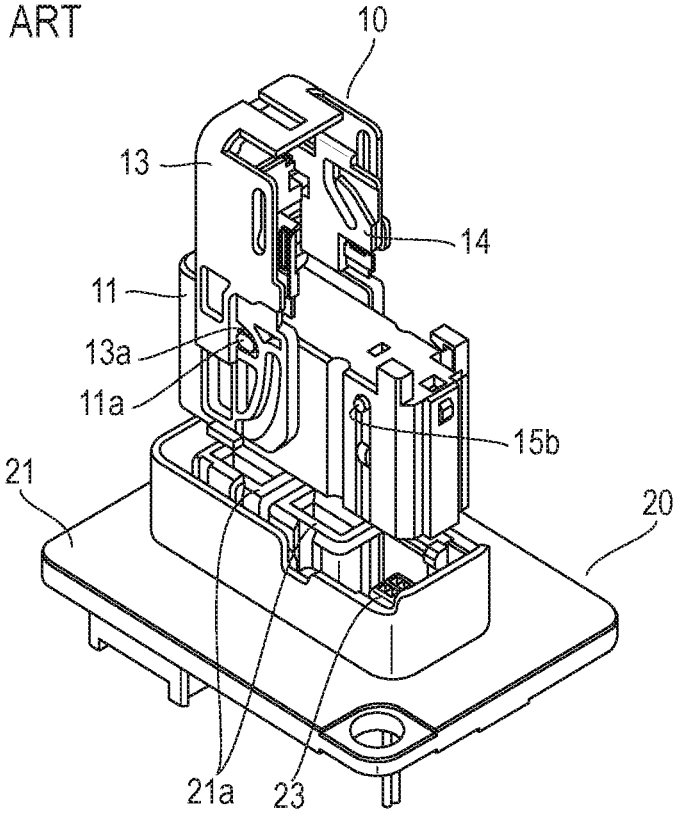
FIG. 1 PRIOR ART
FIG. 1 is a perspective view showing a conventional example (a connector device) of a power-circuit breaking device.
Figure 2:
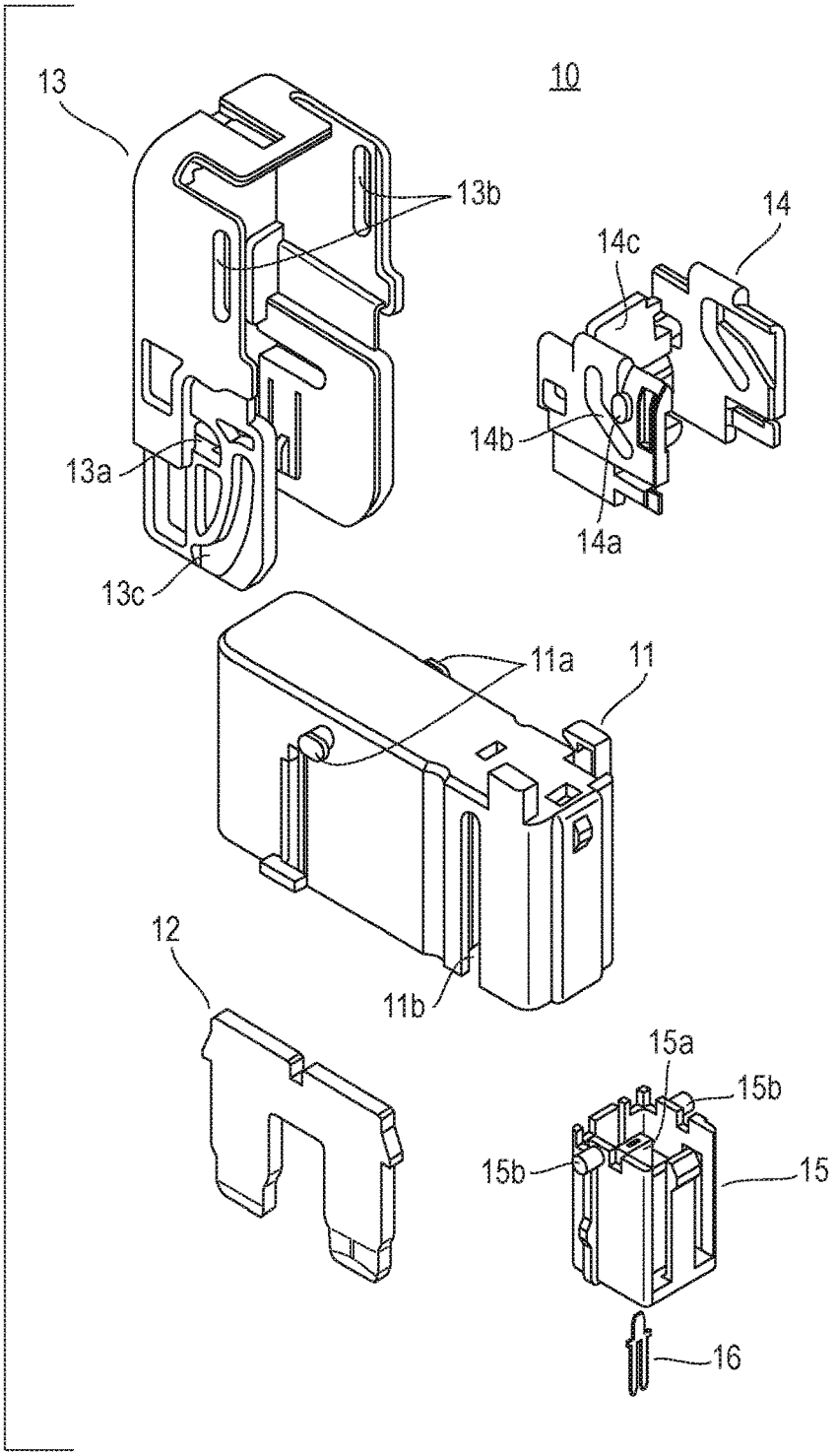
FIG. 2 PRIOR ART
FIG. 2 is an exploded perspective view of the connector device in FIG. 1.
Figure 3:
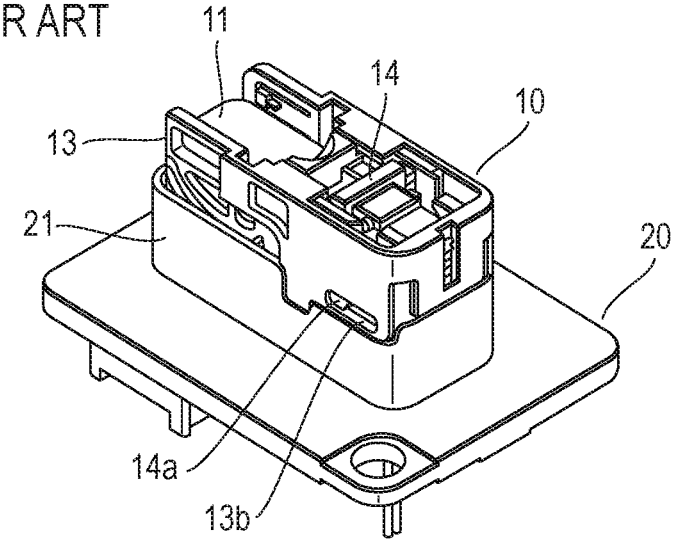
FIG. 3 PRIOR ART
FIG. 3 is a perspective view showing a state where one connector is fit in the other connector and a first operation member is at a first operating position, in the power-circuit breaking device shown in FIG. 1.
Figure 4:
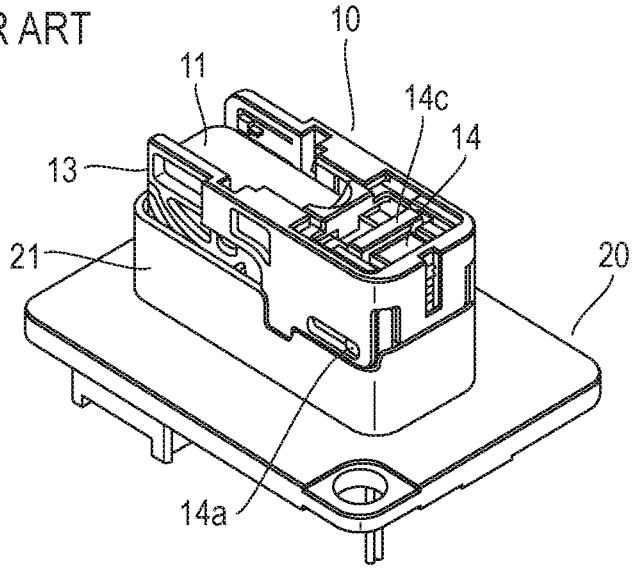
FIG. 4 PRIOR ART
FIG. 4 is a perspective view showing a state where the first operation member is at the first operating position and a second operation member is at a second operating position.
Figure 5:
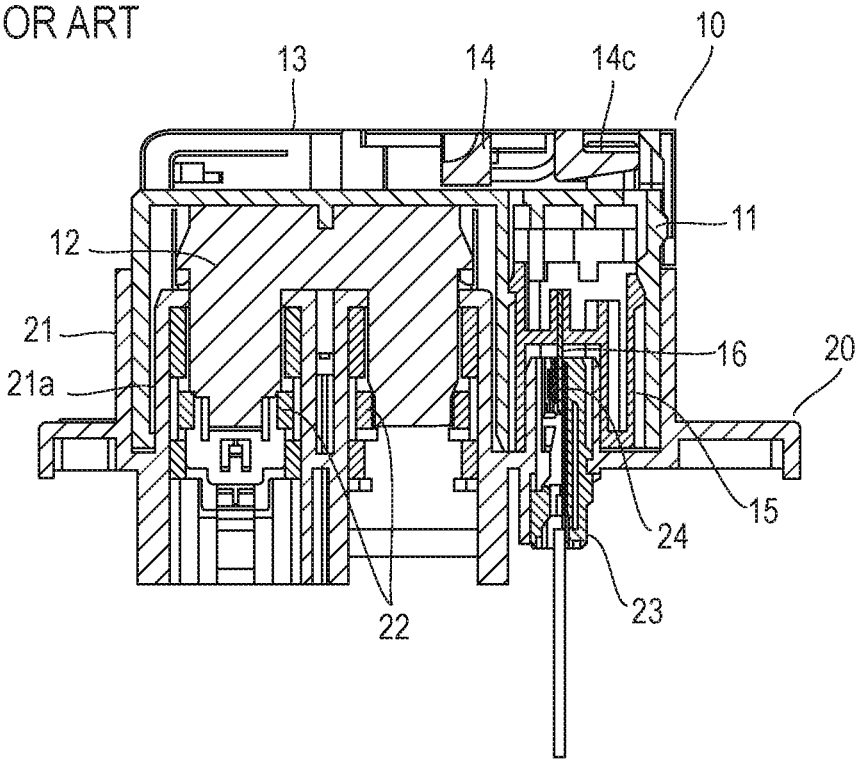
FIG. 5 PRIOR ART
FIG. 5 is a cross-sectional view of the state shown in FIG. 4.
Figure 6:
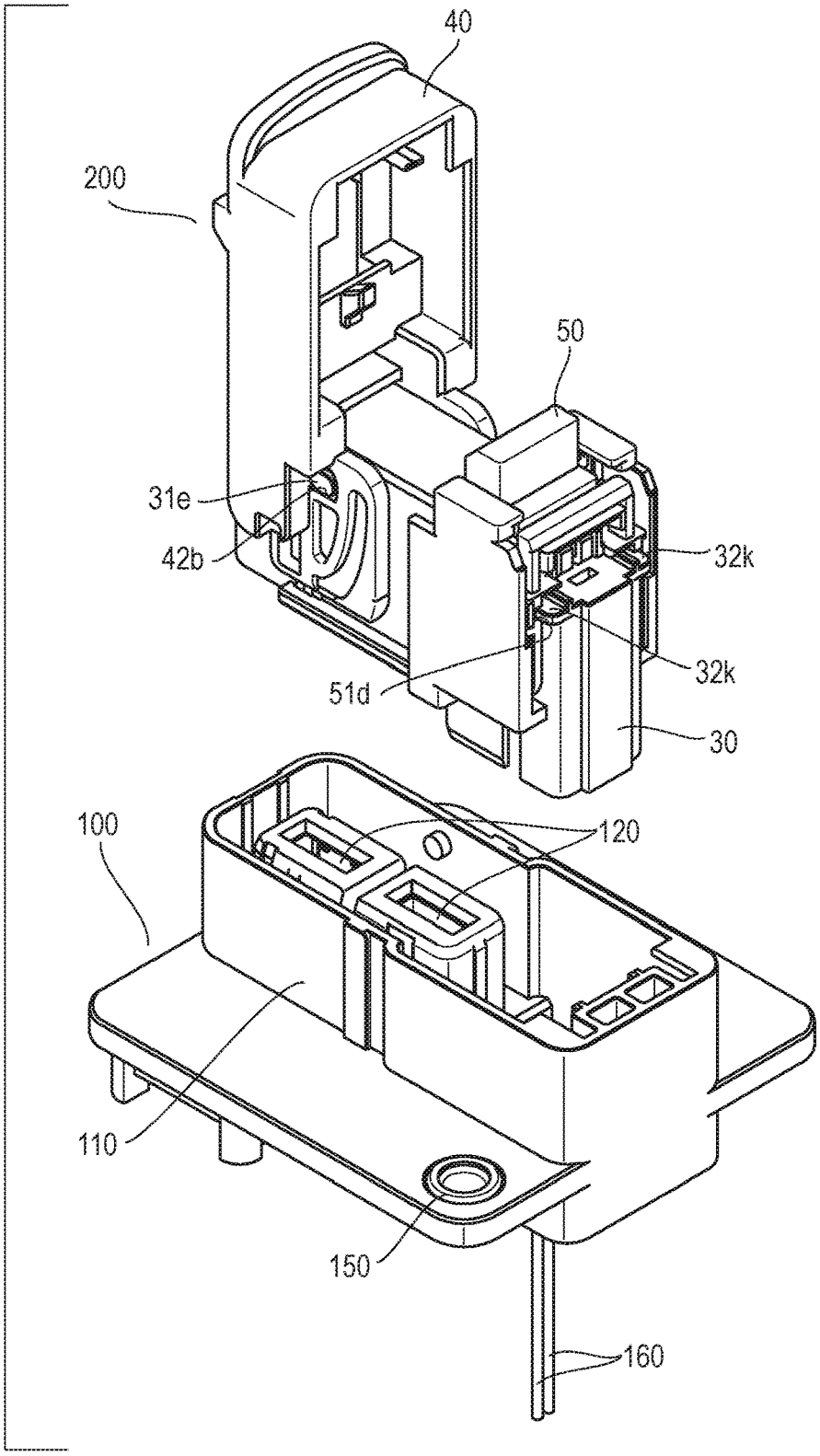
FIG. 6 is a perspective view showing a power-circuit breaking device according to an embodiment of the present invention.
Figure 7:
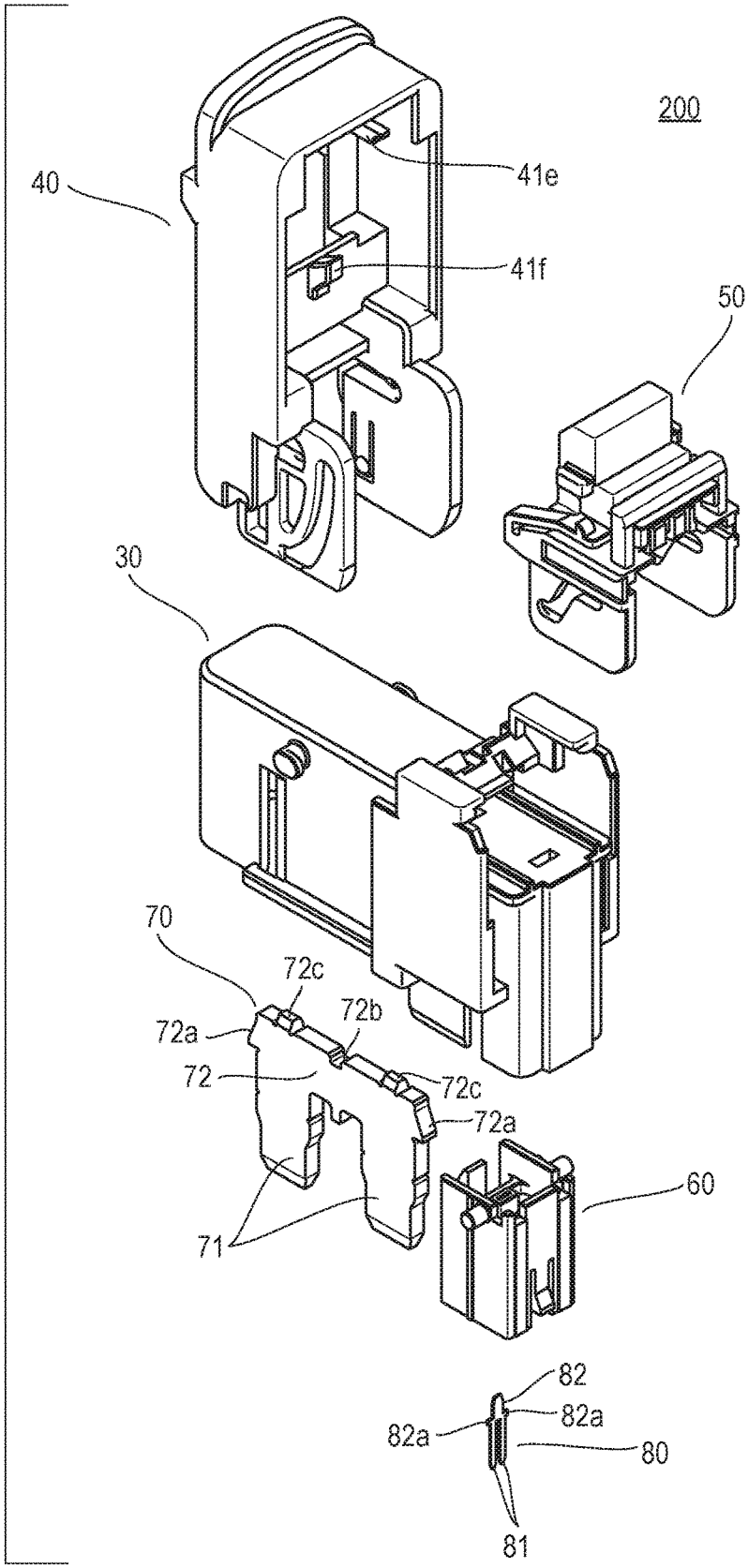
FIG. 7 is an exploded perspective view of a plug shown in FIG. 6.
Figure 8:
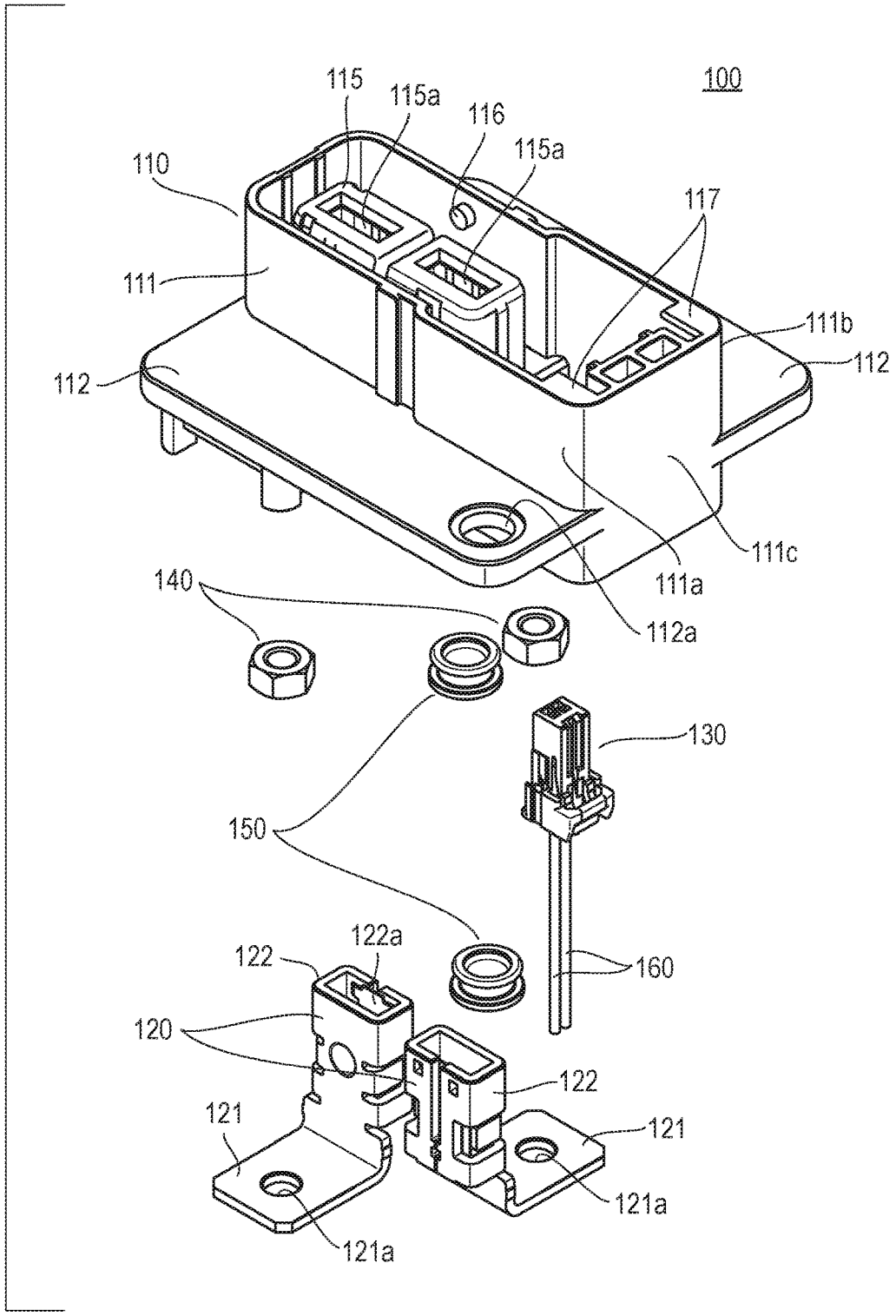
FIG. 8 is an exploded perspective view of a receptacle shown in FIG. 6.
Figure 9C:
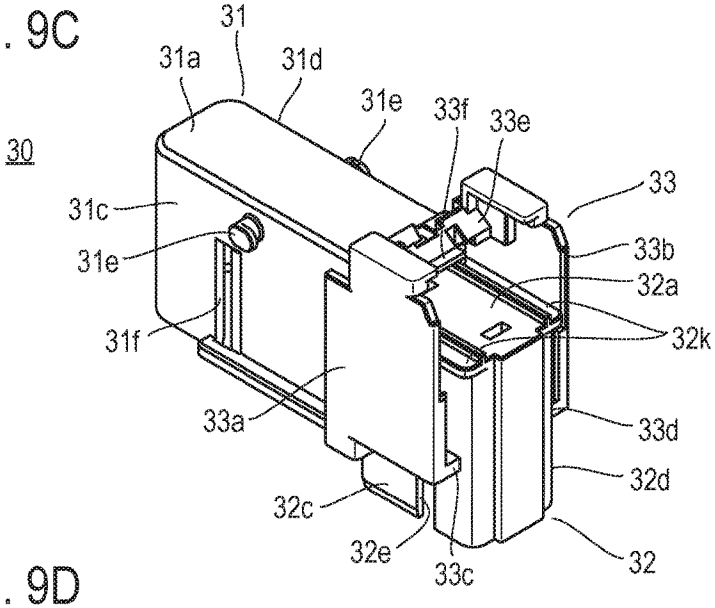
FIG. 9C is a perspective view of the plug housing.
Figure 9D:
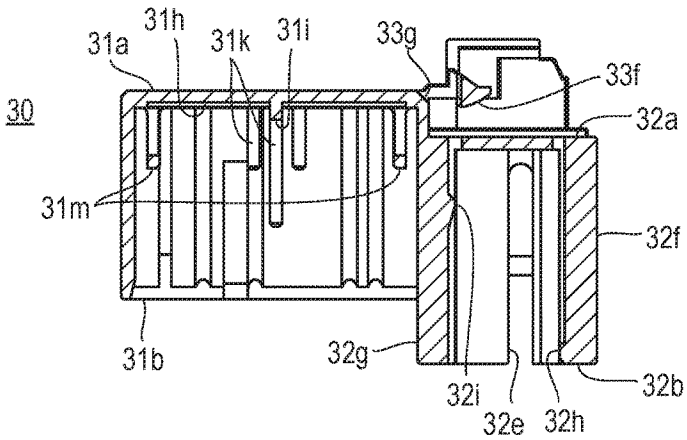
FIG. 9D is a cross-sectional view taken along line E-E in FIG. 9B.
Figure 9A:
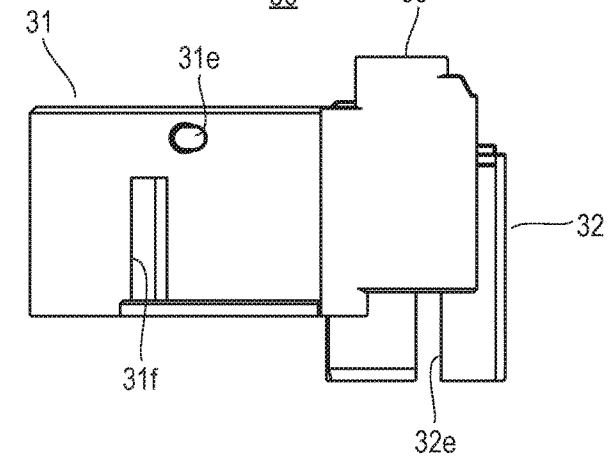
FIG. 9A is a front view of a plug housing shown in FIG. 7.
Figure 9B:
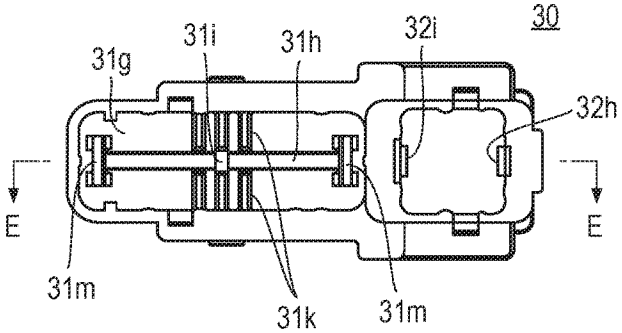
FIG. 9B is a bottom view of the plug housing.
Figure 10C:
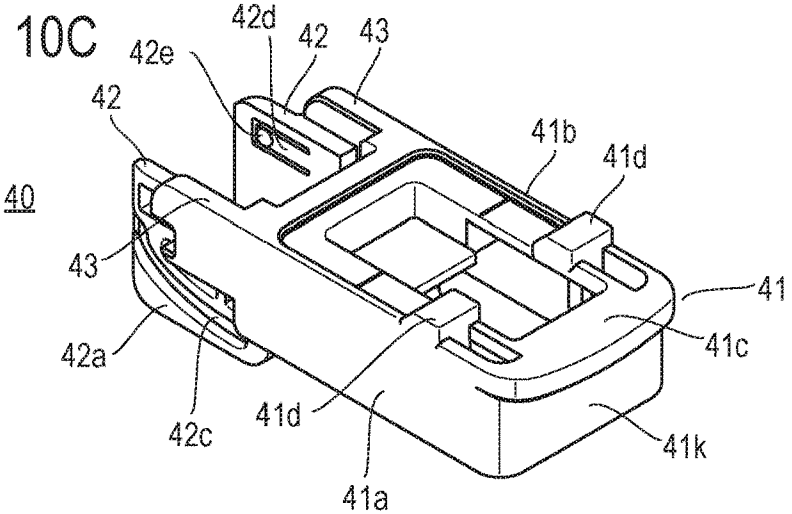
FIG. 10C is a perspective view of the lever.
Figure 10D:
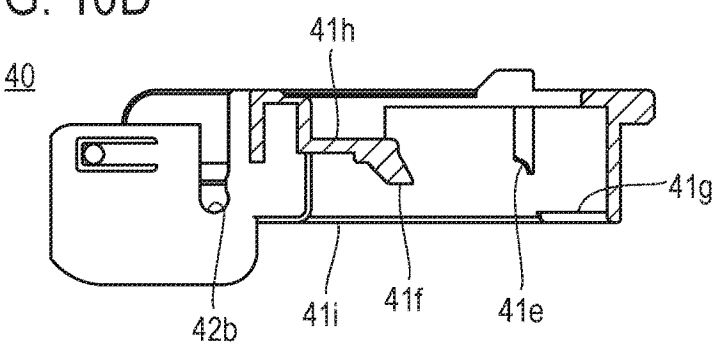
FIG. 10D is a cross-sectional view taken along line E-E in FIG. 10B.
Figure 10A:
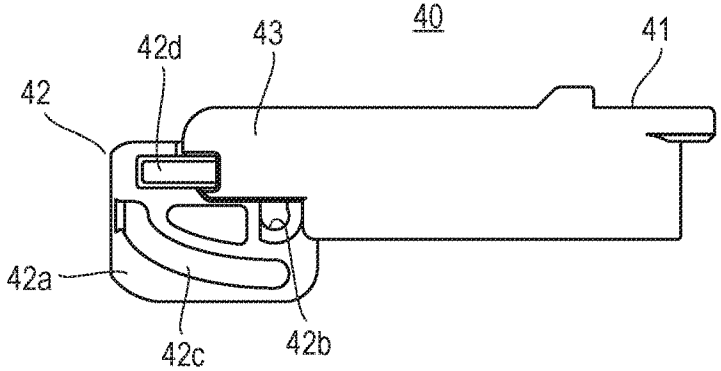
FIG. 10A is a front view of a lever shown in FIG. 7.
Figure 10B:
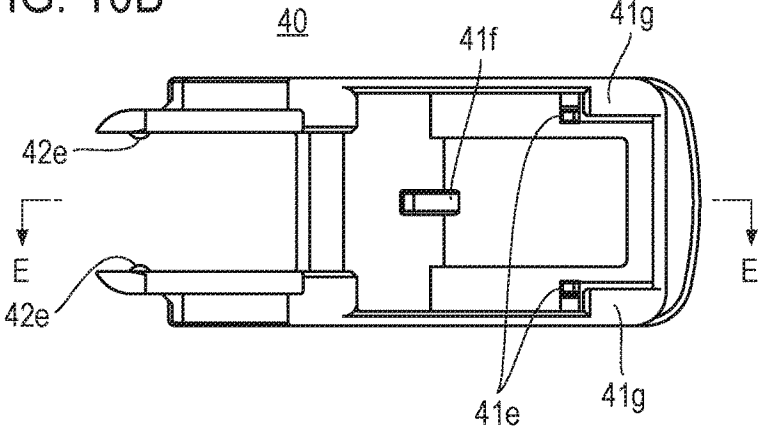
FIG. 10B is a bottom view of the lever.
Figure 11D:
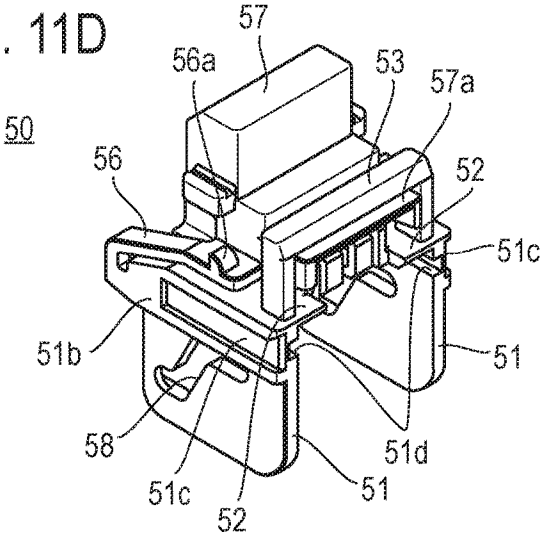
FIG. 11D is a perspective view of the lock slider.
Figure 11E:
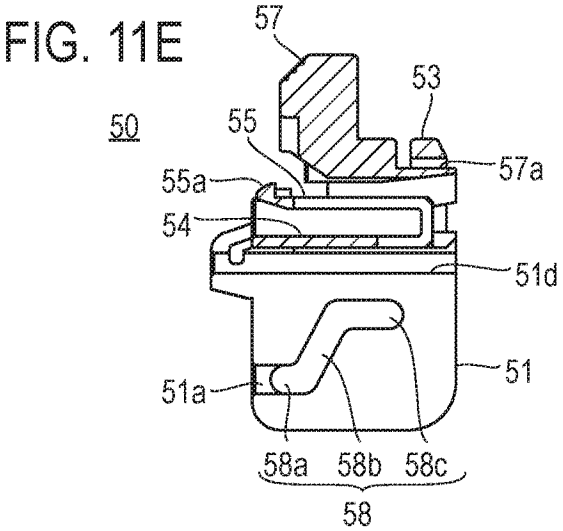
FIG. 11E is a cross-sectional view taken along line F-F in FIG. 10C.
Figure 11C:
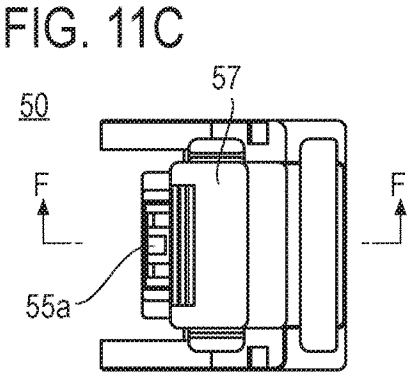
FIG. 11C is a plan view of the lock slider.
Figure 11A:
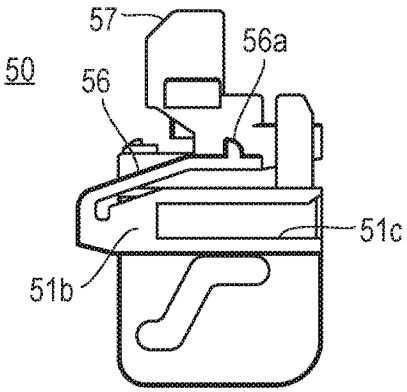
FIG. 11A is a front view of a lock slider shown in FIG. 7.
Figure 11B:
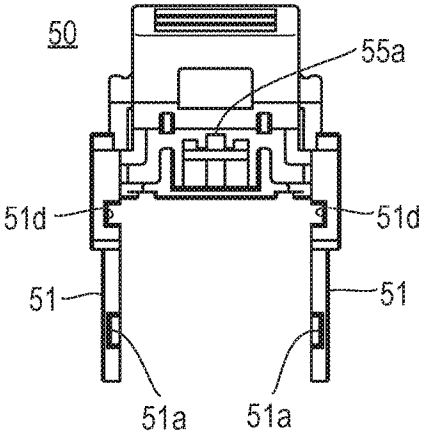
FIG. 11B is a left side view of the lock slider.
Figure 12E:
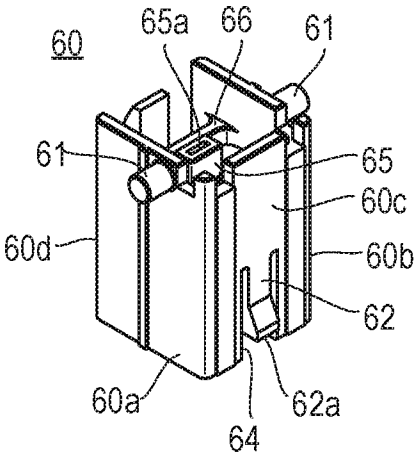
FIG. 12E is a perspective view of the sub-connector.
Figure 12D:
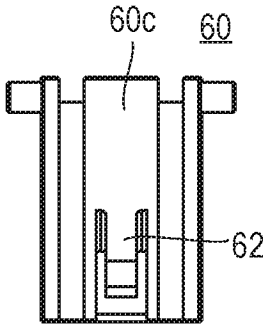
FIG. 12D is a right side view of the sub-connector.
Figure 12F:
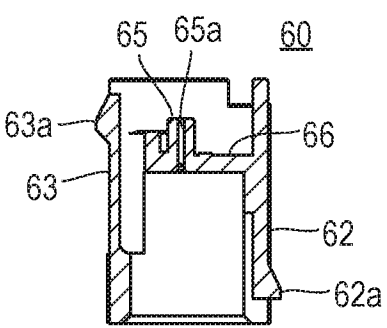
FIG. 12F is a cross-sectional view taken along line G-G in FIG. 12B.
Figure 12A:
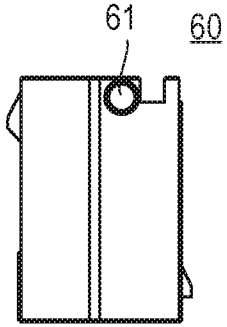
FIG. 12A is a front view of a sub-connector shown in FIG. 7.
Figure 12B:
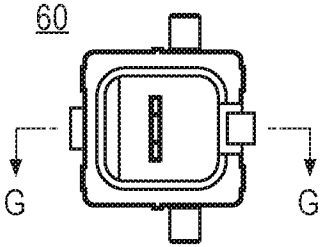
FIG. 12B is a bottom view of the sub-connector.
Figure 12C:
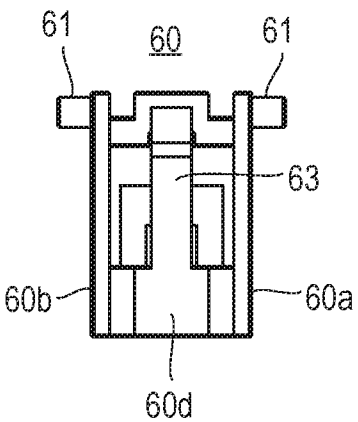
FIG. 12C is a left side view of the sub-connector.
Figure 13C:
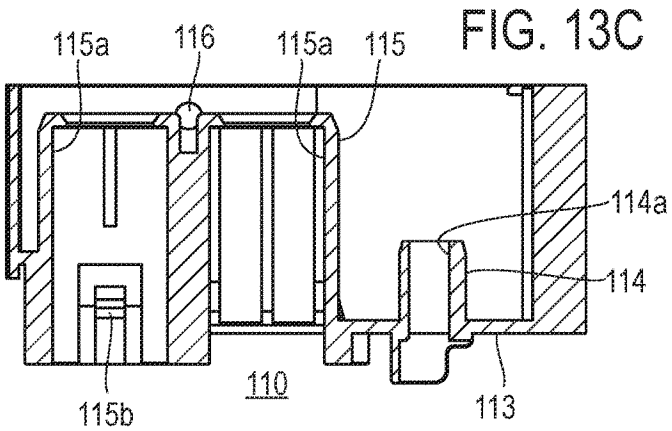
FIG. 13C is a cross-sectional view taken along line E-E in FIG. 13B.
Figure 13D:
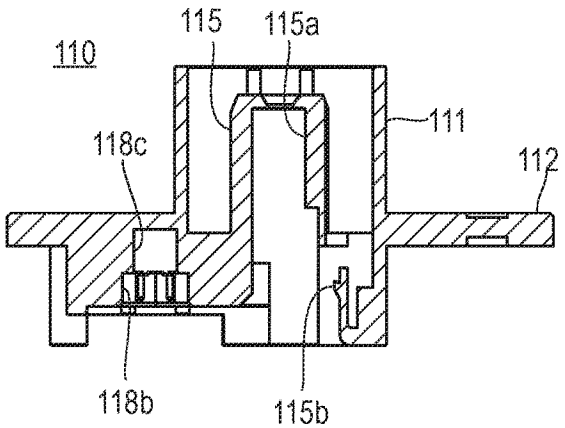
FIG. 13D is a cross-sectional view taken along line F-F in FIG. 13B.
Figure 13A:
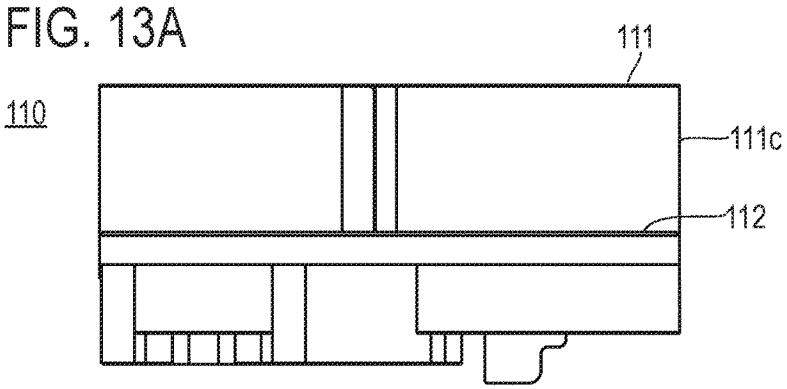
FIG. 13A is a front view of a receptacle housing shown in FIG. 8.
Figure 13B:
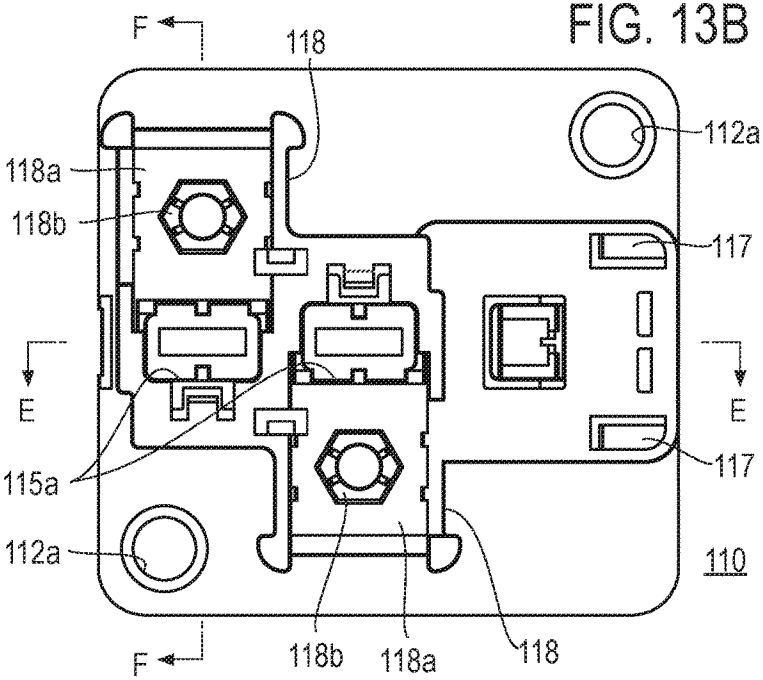
FIG. 13B is a bottom view of the receptacle housing.

FIG. 6 shows a power-circuit breaking device according to an embodiment of the present invention. The power-circuit breaking device includes a receptacle 100 and a plug 200. The power-circuit breaking device is configured such that the plug 200 can be inserted into the receptacle 100 and be removed from the receptacle 100. FIG. 7 shows portions constituting the plug 200. FIG. 8 shows portions constituting the receptacle 100.

As shown in FIG. 7, the plug 200 includes a plug housing 30, a lever 40, a lock slider 50, a sub-connector 60, a main terminal 70, and a sub-terminal 80. As shown in FIG. 8, the receptacle 100 includes a receptacle housing 110, one pair of power terminals 120, a connector 130 which holds one pair of signal terminals, two nuts 140, and two collars 150. FIGS. 9 to 13 show the configurations of the plug housing 30, the lever 40, the lock slider 50, the sub-connector 60, and the receptacle housing 110, respectively. The parts shown in FIGS. 9A to 13D are made of, for example, resin unless otherwise noted. Note that reference numeral 160 in FIG. 8 denotes a lead wire which is led out from the connector 130. The lead wires 160 are connected to one pair of signal terminals 170.

The configurations of the portions of the plug 200 will be described first.

As shown in FIGS. 9A to 9D, the plug housing 30 includes a first rectangular tube portion 31 and a second rectangular tube portion 32. The first rectangular tube portion 31 and the second rectangular tube portion 32 each have a hollow structure. The first rectangular tube portion 31 and the second rectangular tube portion 32 are each open at a bottom. The shape of a top portion 31*a* of the first rectangular tube portion 31 is an elongated, substantially rectangular shape. The second rectangular tube portion 32 is adjacent to a short side of the first rectangular tube portion 31. A top portion 32*a* of the second rectangular tube portion 32 is below the level of the top portion 31*a* of the first rectangular tube portion 31. A bottom portion 32*b* of the second rectangular tube portion 32 is located below the level of a bottom portion 31*b* of the first rectangular tube portion 31.

Two side walls 31*c* and 31*d* which are located in a width direction of the first rectangular tube portion 31 (a short side direction of the top portion 31*a*) have respective shafts 31*e* formed to protrude outward along the width direction. The two side walls 31*c* and 31*d* have respective slits 31*f* formed to extend in a height direction of the first rectangular tube portion 31. A groove 31*h* which extends in a long side direction of the top portion 31*a* is formed in an inner surface 31*g* of the top portion 31*a* of the first rectangular tube portion 31. A protruding portion 31*i* which divides the groove 31*h* is formed at the center in an extension direction of the groove 31*h*. Near the center in the extension direction of the groove 31*h*, three pairs of ribs 31*k*, each pair of ribs 31*k* sandwiching the groove 31*h*, are formed on two sides in a width direction of the groove 31*h*. Each rib 31*k* protrudes toward the bottom portion 31*b* of the first rectangular tube portion 31. The level of the ribs 31*k* located at the center of the three pairs of ribs 31*k* is higher than those of the other ribs 31*k*. Respective holding portions 31*m* in the shape of a staple are formed at two ends in the extension direction of the groove 31*h*. Two ends of each holding portion 31*m* are located on the inner surface 31*g*. The holding portions 31*m* stand toward the bottom portion 31*b*.

Slits 32*e* which extend in a height direction of the second rectangular tube portion 32 are formed in side walls 32*c* and 32*d* of the second rectangular tube portion 32 which are parallel to the side walls 31*c* and 31*d* of the first rectangular tube portion 31. A lower end of each slit 32*e* leads to the bottom portion 32*b* of the second rectangular tube portion 32. The slit 32*e* is open at the lower end. Respective projections 32*h* and 32*i* are formed on inner surfaces of two remaining side walls 32*f* and 32*g* of the second rectangular tube portion 32. The projection 32*h* is located at a lower end of the second rectangular tube portion 32. The projection 32*i* is located on an upper end side of the second rectangular tube portion 32. Rails 32*k* which protrude outward along a width direction are formed at upper ends of the side walls 32*c* and 32*d* of the second rectangular tube portion 32. Each rail 32*k* extends from the side wall 32*f* to the side wall 32*g*.

An outer frame portion 33 is formed outside the second rectangular tube portion 32. The outer frame portion 33 has one pair of plate portions 33*a* and 33*b* which are parallel to the side walls 32*c* and 32*d*. The one pair of plate portions 33*a* and 33*b* is located, with a predetermined spacing between itself and the side walls 32*c* and 32*d* of the second rectangular tube portion 32, outside the side walls 32*c* and 32*d*. Respective lower ends of the plate portions 33*a* and 33*b* are joined to the side walls 32*c* and 32*d* of the second rectangular tube portion 32 by support portions 33*c* and 33*d*.

Upper ends of the plate portions 33*a* and 33*b* are located above the level of the top portion 31*a* of the first rectangular tube portion 31. A joining portion 33*e* which joins the plate portions 33*a* and 33*b* is formed on upper end sides of the plate portions 33*a* and 33*b*. A locking portion 33*f* is formed at the center in a joining direction of the joining portion 33*e*. A window 33*g* is formed between the locking portion 33*f* and the top portion 31*a* of the first rectangular tube portion 31.

The lever 40 has the shape shown in FIGS. 10A to 10D. The shape of an operation portion 41 is the shape of a frame. One pair of support portions 42 is formed on one end side in a longitudinal direction of a frame constituted by the operation portion 41. The shape of each of the one pair of support portions 42 is the shape of a plate. The support portions 42 as one pair face each other. The one pair of support portions 42 extends in the longitudinal direction of the operation portion 41. The spacing between two outer side surfaces 42*a* of the one pair of support portions 42 is smaller than the width of the operation portion 41. Extension portions 43 are located on respective parts of the two outer side surfaces 42*a*. The two extension portions 43 are respective extensions of side walls 41*a* and 41*b* along the longitudinal direction of the operation portion 41.

Respective through-holes 42*b* are formed in the support portions 42. Respective substantially arc-shaped cam grooves 42*c* are formed in the outer side surfaces 42*a*. Respective one ends of the cam grooves 42*c* lead to distal ends (distal ends farther away from a front wall 41*k* of the operation portion 41) of the support portions 42. Respective cantilever-shaped positioning pieces 42*d* are formed at the support portions 42. Each positioning piece 42*d* is formed by cutting a groove in the support portion 42. A projection 42*e* which protrudes inward is formed at a free end of each positioning piece 42*d*.

One pair of protruding portions 41*d* is formed on an upper surface of an upper plate portion 41*c* which is located on the side walls 41*a* and 41*b* of the operation portion 41 and has the shape of a frame. Each of the one pair of protruding portions 41*d* protrudes. One pair of columnar locking portions 41*e* is formed on an inner surface of the upper plate portion 41*c*. Each of the one pair of locking portions 41*e* protrudes. The one pair of protruding portions 41*d* and the one pair of locking portions 41*e* are formed on a distal end side (a side opposite to a side where the support portions 42 are located) of the operation portion 41 and on two sides in a width direction of the operation portion 41.

A projection 41*f* and one pair of regulating pieces 41*g* are formed at the operation portion 41. The projection 41*f* is formed on a proximal end side (the side where the support portions 42 are located) of the operation portion 41 and at a distal end of an L-shaped plate portion 41*h*. The L-shaped plate portion 41*h* has an L-shape in cross-section. The L-shaped plate portion 41*h* protrudes from the inner surface of the upper plate portion 41*c*. The projection 41*f* is located at the center in the width direction of the operation portion 41 inside the frame constituted by the operation portion 41. The projection 41*f* protrudes toward a bottom 41*i* of the operation portion 41. One of the regulating pieces 41*g* is located at the bottom 41*i* on the distal end side of the operation portion 41. The one of the regulating pieces 41*g* is supported by the front wall 41*k* and the side wall 41*a* of the operation portion 41. The other of the regulating pieces 41*g* is located at the bottom 41*i* on the distal end side of the operation portion 41. The other of the regulating pieces 41*g* is supported by the front wall 41*k* and the side wall 41*b*. Each regulating piece 41*g* has the shape of a plate along the bottom 41*i* of the operation portion 41.

As shown in FIGS. 11A to 11E, the lock slider 50 includes one pair of side plate portions 51, support plate portions 52, a guard portion 53, a joining plate portion 54, a first locked piece 55 which extends from the joining plate portion 54, and a button 57. The side plate portions 51 as one pair face each other. The support plate portions 52 are located at respective upper ends of the side plate portions 51. The support plate portions 52 protrude inward. The guard portion 53 is formed on the support plate portions 52 on one end sides (rear end sides) of the support plate portions 52. The guard portion 53 lies astride the two support plate portions 52. The joining plate portion 54 joins other end sides (front end sides) of the support plate portions 52. The button 57 is supported by the one pair of side plate portions 51 via one pair of second locked pieces 56.

Respective cam grooves 58 are formed in the side plate portions 51. Each cam groove 58 includes a front horizontal portion 58*a*, an inclined portion 58*b*, and a rear horizontal portion 58*c*. The inclined portion 58*b* extends obliquely upward (toward the support plate portion 52 side) from a rear end of the front horizontal portion 58*a*. The rear horizontal portion 58*c* extends in a horizontal direction from an upper end of the inclined portion 58*b*. The cam groove 58 extends through the side plate portion 51. A concave portion 51*a* which leads to a front end face of each side plate portion 51 that is located on an extension of the front horizontal portion 58*a* is formed in an inner side surface of the side plate portion 51.

A raised portion 51*b* is formed at an outer side surface on an upper end side of each side plate portion 51. The thickness of the raised portion 51*b* is larger than that of the corresponding side plate portion 51. A groove 51*c* which extends in a front-back direction is formed in the raised portion 51*b*. A rear end of the groove 51*c* leads to a rear end face of the side plate portion 51. The groove 51*c* is open at the rear end. A guide groove 51*d* which extends in the front-back direction from the front end face to the rear end face of the side plate portion 51 is formed in the inner side surface on the upper end side of the side plate portion 51.

Each second locked piece 56 protrudes forward from a front end side of the raised portion 51*b*, bends upward, and again bends rearward. The button 57 that joins the one pair of second locked pieces 56 is formed on a distal end side (free end side) of the one pair of second locked pieces 56. One pair of lugs 56*a* is formed at free ends of the second locked pieces 56 located on two sides of the button 57. The one pair of lugs 56*a* protrudes upward. An extension portion 57*a* which extends rearward is formed at the button 57. The extension portion 57*a* is inserted in a space inside the staple-shaped guard portion 53.

The first locked piece 55 extends rearward from a rear end face of the joining plate portion 54, is reflexed, and extends further forward. The first locked piece 55 is located below the button 57. A free end of the first locked piece 55 is located above the joining plate portion 54 and in front of the button 57. A lug 55*a* is formed to face upward at the free end of the first locked piece 55. An excessive motion in a depression direction of the first locked piece 55 is inhibited by the joining plate portion 54. An excessive motion in a pull-up direction of the button 57, that is, an excessive motion in the pull-up direction of each second locked piece 56 is inhibited by the guard portion 53.

As shown in FIGS. 12A to 12F, the sub-connector 60 has the shape of a rectangular tube which is open at two end faces (upper and lower surfaces). Bosses 61 which protrude outward are formed on upper end sides of side walls 60*a* and 60*b* which face each other. Spring pieces 62 and 63 are formed at remaining side walls 60*c* and 60*d*, respectively. The spring piece 62 is located in a notch 64 which is formed on a lower end side of the side wall 60*c*. The spring piece 62 extends in a vertical direction. A lower end of the spring piece 62 (on the lower end side of the side wall 60*c*) is a free end. A protruding portion 62*a* is formed at the free end. The protruding portion 62*a* protrudes outward from the side wall 60*c*. The side wall 60*d* has such a shape that the side wall 60*d* is located only on lower end sides of the side walls 60*a* and 60*b*. The spring piece 63 extends upward from an upper end face of the side wall 60*d*. A protruding portion 63*a* is formed at a free end of the spring piece 63. The protruding portion 63*a* protrudes outward from the side wall 60*d*.

An attachment portion 65, to which the sub-terminal 80 is to be attached, is formed inside the sub-connector 60. A hole 65*a*, into which the sub-terminal 80 is to be pushed, is formed in the attachment portion 65. The hole 65*a* is a hole which extends in the vertical direction. The attachment portion 65 is fixed to inner surfaces of the side walls 60*a*, 60*b*, and 60*c* via a support portion 66.

As shown in FIG. 7, the main terminal 70 has the shape of a plate which is obtained by joining one end sides (upper end sides) of one pair of contact pieces 71 by a joining portion 72. Lugs 72*a* which protrude outward are formed at two end faces in a width direction of the joining portion 72. A concave portion 72*b* is formed at the center in the width direction of an upper end face (an end face on a side opposite to a side where the contact pieces 71 are located) of the joining portion 72. Respective convex portions 72*c* are formed on two sides in the width direction of the concave portion 72*b*.

As shown in FIG. 7, the sub-terminal 80 has the shape of a plate which is obtained by joining upper end sides of one pair of contact pieces 81 by a joining portion 82, like the main terminal 70. Lugs 82*a* which protrude outward are formed at two end faces in a width direction of the joining portion 82.

Assembly of the plug 200 will be described.

The main terminal 70 is inserted into the first rectangular tube portion 31 of the plug housing 30, thereby attaching the main terminal 70 to the plug housing 30. The one pair of lugs 72*a* catches on the one pair of holding portions 31*m* inside the first rectangular tube portion 31 to hold the main terminal 70. The one pair of convex portions 72*c* of the main terminal 70 is located in the groove 31*h* of the first rectangular tube portion 31. The protruding portion 31*i* formed at the groove 31*h* fits into the concave portion 72*b*. In this manner, the main terminal 70 is positioned inside the first rectangular tube portion 31. The main terminal 70 is prevented from inclining by being sandwiched between the six ribs 31*k* in total of the first rectangular tube portion 31.

The joining portion 82 having the lugs 82*a* is press-fit into the hole 65*a* of the attachment portion 65 of the sub-connector 60, thereby attaching the sub-terminal 80 to the sub-connector 60.

The sub-connector 60 is inserted into the second rectangular tube portion 32 of the plug housing 30, thereby storing the sub-connector 60 that holds the sub-terminal 80 in the plug housing 30. The sub-connector 60 is movable in the vertical direction inside the plug housing 30. When the sub-connector 60 is pushed into the plug housing 30, the protruding portion 62*a* of the spring piece 62 climbs over the projection 32*h* of the second rectangular tube portion 32 and is located on an upper portion of the projection 32*h*. The one pair of bosses 61 of the sub-connector 60 is located in the slits 32*e* of the second rectangular tube portion 32. Distal ends of the one pair of bosses 61 protrude to outside the side walls 32*c* and 32*d*.

The lock slider 50 is inserted into the outer frame portion 33 from a rear side (a side where the second rectangular tube portion 32 is located) of the plug housing 30, thereby attaching the lock slider 50 to the plug housing 30. The one pair of rails 32*k* of the plug housing 30 is located in the one pair of guide grooves 51*d* of the lock slider 50. Thus, the lock slider 50 can slide in a front-back direction of the plug housing 30 by being guided along the rails 32*k*.

When the lock slider 50 is pushed in, the one pair of bosses 61 of the sub-connector 60 passes through the concave portions 51*a* formed in the one pair of side plate portions 51 of the lock slider 50 and fit into the cam grooves 58. In this manner, the sub-connector 60 is supported by the lock slider 50. When the lock slider 50 is further pushed in, the lug 55*a* of the first locked piece 55 is located at the window 33*g* of the plug housing 30 and catches on the locking portion 33*f*. In this manner, the lock slider 50 is locked onto the plug housing 30. With the push, the one pair of bosses 61 of the sub-connector 60 moves along the cam grooves 58 of the lock slider 50. In this manner, the sub-connector 60 moves upward, and the protruding portion 63*a* of the spring piece 63 climbs over the projection 32*i* formed on the side wall 32*g* of the second rectangular tube portion 32 and is located on an upper portion of the projection 32*i*. At this time, the one pair of bosses 61 of the sub-connector 60 is located at the rear horizontal portions 58*c* of the cam grooves 58.

The shafts 31*e* of the plug housing 30 are inserted into the one pair of through-holes 42*b* of the lever 40, thereby attaching the lever 40 to the plug housing 30. The lever 40 can tilt about the shafts 31*e* as pivots.

Through the above-described steps, the assembly of the plug 200 shown in FIG. 6 is completed. Note that the positioning pieces 42*d* formed at the lever 40 are located in the slits 31*f* formed in the plug housing 30, thereby maintaining the lever 40 in an upright state (a state at an open position) with respect to the plug housing 30, as shown in FIG. 6.

The configurations of the receptacle housing 110 and the power terminal 120 will be described.

As shown in FIGS. 8 and 13A to 13D, the receptacle housing 110 includes an elongated rectangular tube portion 111. A flange 112 in the shape of a flat plate is formed on two sides in a width direction of the rectangular tube portion 111. Two holes 112*a* for collar attachment are formed in the flange 112. The two holes 112*a* are provided at corners on a diagonal line of the flange 112. The rectangular tube portion 111 is open at one end (upper end). A bottom plate 113 is formed at the other end (lower end) of the rectangular tube portion 111.

An attachment portion 114 for the connector 130 and an attachment portion 115 for the one pair of power terminals 120 are formed at the bottom plate 113. Each of the attachment portion 114 and the attachment portion 115 protrudes vertically from the bottom plate 113. A hole 114*a* which extends in the vertical direction is formed in the attachment portion 114. One pair of holes 115*a* which extends in the vertical direction is formed in the attachment portion 115. An upper end of each hole 115*a* is narrow. A lance 115*b* for power terminal holding is formed at a lower end of the hole 115*a*.

Bosses 116 which protrude inward are formed on upper end sides of inner surfaces of side walls 111*a* and 111*b* (parts on a side where the attachment portion 115 is formed) along a longitudinal direction of the rectangular tube portion 111. In the side walls 111*a* and 111*b* (parts on a side where the attachment portion 114 is formed), respective regulating pieces 117 are formed at corners between a side wall 111*c* along the width direction of the rectangular tube portion 111 and the side walls 111*a* and 111*b*. Each regulating piece 117 has the shape of a flat plate. The regulating pieces 117 are located at a top of the rectangular tube portion 111.

An outer shape of a part, located on a lower side of the flange 112, of the rectangular tube portion 111 (a part on the side where the attachment portion 115 is formed) is different from an outer shape of a part, located on an upper side of the flange 112, of the rectangular tube portion 111 (a part on the side where the attachment portion 115 is formed). The part, located on the lower side of the flange 112, of the rectangular tube portion 111 (the part on the side where the attachment portion 115 is formed) has extension portions 118 corresponding to the positions of the two holes 115*a*. The extension portions 118 extend in the width direction of the rectangular tube portion 111. A recess 118*a* is formed in each extension portion 118. The recess 118*a* extends from an extension end of the extension portion 118 to the hole 115*a*. Respective nut storage portions 118*b* are formed in the two recesses 118*a*. A hole 118*c* is formed at a bottom of an inside of each nut storage portion 118*b*.

As shown in FIG. 8, the power terminals 120 each include a terminal portion 121 in the shape of a flat plate and a connecting portion 122 which is continuous with the terminal portion 121. The connecting portion 122 has the shape of a rectangular tube. A contact piece 122*a* is held inside the connecting portion 122. A hole 121*a* is formed in the terminal portion 121.

The receptacle 100 is assembled by attaching the one pair of power terminals 120, the connector 130, the two nuts 140, and the two collars 150 to the receptacle housing 110.

Each collar 150 is attached to the hole 112*a* of the flange 112. The collar 150 functions as a reinforcing member at the time of, for example, attaching the flange 112 to an enclosure with a bolt. The collar 150 is made of metal. The collar 150 has such a thickness that upper and lower surfaces of the collar 150 protrude slightly from plate surfaces of the flange 112. Attachment of the collar 150 prevents occurrence of the problem of damage to the resin flange 112 caused by a force to tighten a bolt.

The connector 130 is press-fit into the attachment portion 114 of the receptacle housing 110 from below the attachment portion 114.

The nuts 140 are stored in the nut storage portions 118*b* of the receptacle housing 110. In this state, the one pair of power terminals 120 is attached to the attachment portion 115. The connecting portion 122 of each power terminal 120 is inserted into the hole 115*a* of the attachment portion 115 from below the hole 115*a*. The lance 115*b* prevents the power terminal 120 from coming off. The terminal portion 121 of the power terminal 120 is located in the recess 118*a* formed in the extension portion 118 of the receptacle housing 110. The nut 140 is sandwiched between the terminal portion 121 of the power terminal 120 and the receptacle housing 110. The position of the hole 121*a* of the terminal portion 121 coincides with the position of a hole of the nut 140.

As described earlier, the receptacle 100 thus assembled is attached to a housing with bolts at the flange 112. A part, located on the lower side of the flange 112, of the receptacle 100 is stored in the housing. Power lines for a power circuit are connected to the terminal portions 121 of the one pair of power terminals 120. Each power line is, for example, a strip-shaped copper plate. The terminal portion 121 is connected to the copper plate as the power line by screwing a bolt (not shown) into the nut 140.

The one pair of lead wires 160 led out from the connector 130 is connected to a switch which turns on or off electricity to a power circuit.

Connection of and the operation of the plug 200 and the receptacle 100 with the above-described configurations will be described in order with reference to FIGS. 14A to 17C.

Figure 14B:
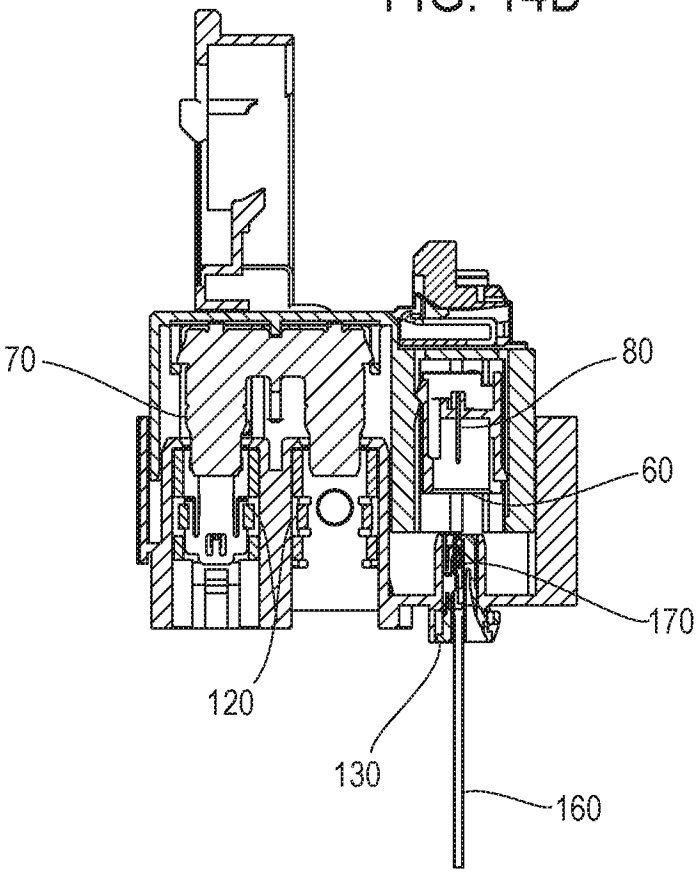
FIG. 14B is a cross-sectional view of the state where the plug is inserted in the receptacle.
Figure 14A:
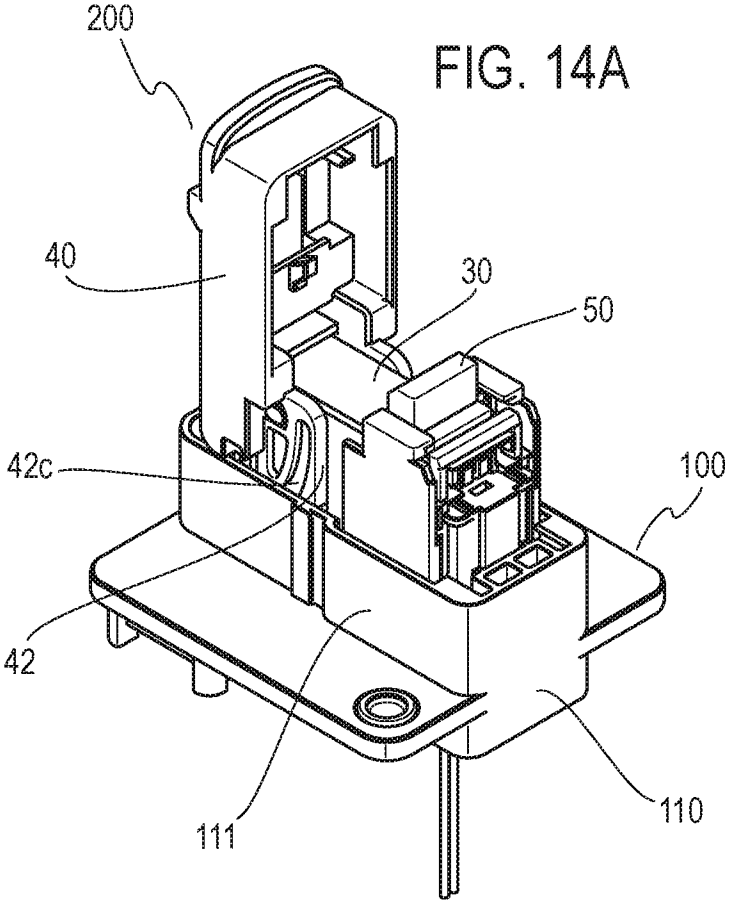
FIG. 14A is a perspective view showing a state where the plug is inserted in the receptacle.

(1) As shown in FIGS. 14A and 14B, in a state where the lever 40 is located at the open position, the plug 200 is inserted into the receptacle 100. The plug 200 is inserted into the rectangular tube portion 111 of the receptacle housing 110. With this insertion, the plug 200 is positioned in the longitudinal direction and the width direction of the rectangular tube portion 111. The one pair of bosses 116 formed at the receptacle housing 110 enters into the cam grooves 42*c* formed in the lever 40. Note that, in a state where the lever 40 is not located at the open position, an open portion of each cam groove 42*c* of the lever 40 and the boss 116 of the receptacle housing 110 do not coincide in position and that the boss 116 hits an end face of the support portion 42 of the lever 40. For this reason, the plug 200 cannot be inserted into the receptacle 100.

Figure 15C:
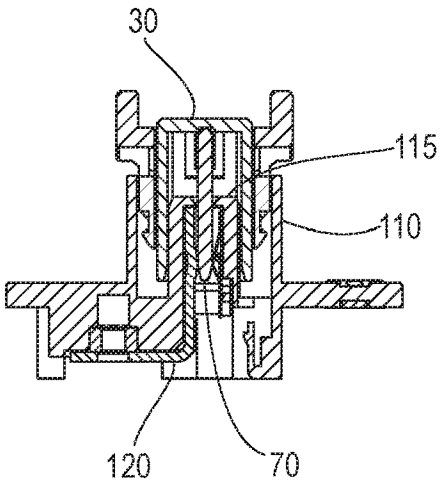
FIG. 15C is a cross-sectional view taken along line D-D in FIG. 15B.
Figure 15B:
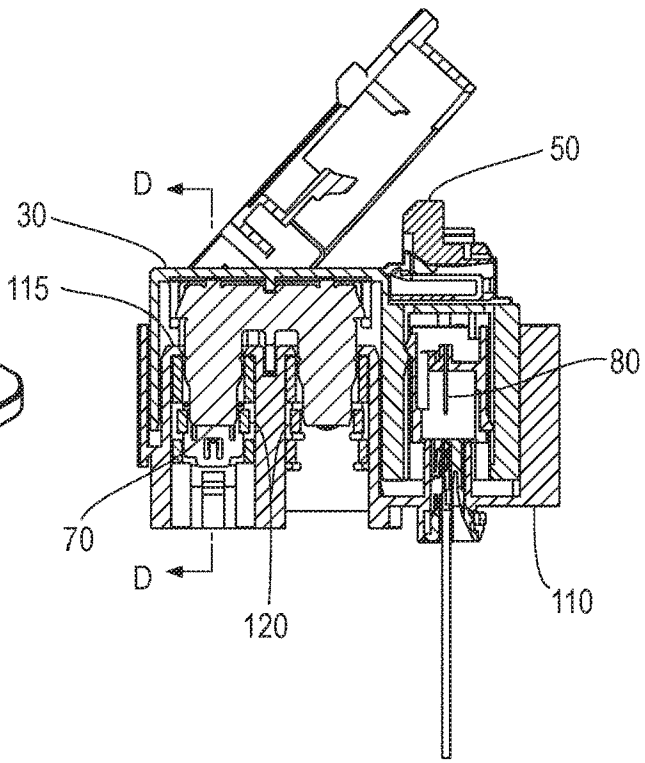
FIG. 15B is a cross-sectional view of the state where the lever is tilted.
Figure 15A:
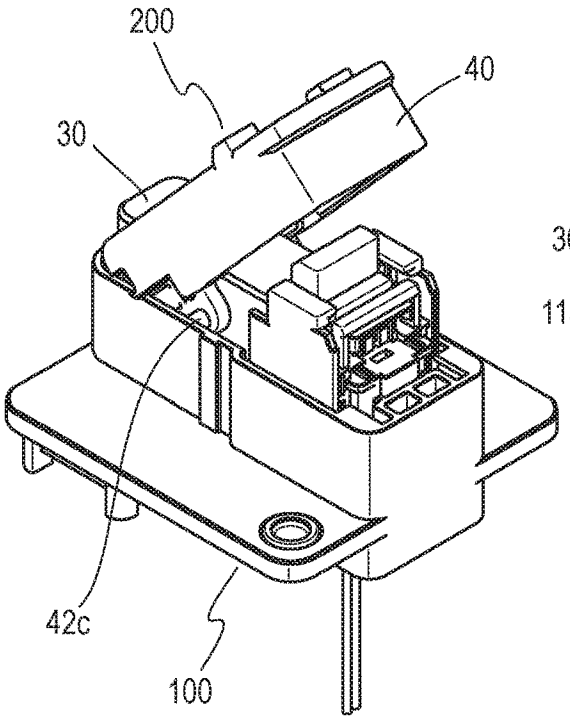
FIG. 15A is a perspective view showing a state where the lever in the state shown in FIGS. 14A and 14B is tilted.

(2) As shown in FIGS. 15A to 15C, the lever 40 is tilted. When the lever 40 is tilted, each boss 116 of the receptacle housing 110 moves in the cam groove 42*c*, and a cam mechanism including the cam grooves 42*c* and the bosses 116 causes the plug 200 to enter into the receptacle housing 110. With movement of the plug housing 30 relative to the receptacle housing 110, the main terminal 70 held by the plug housing 30 is connected to the one pair of power terminals 120 attached to the attachment portion 115 of the receptacle housing 110, as shown in FIGS. 15B and 15C. In this manner, a power circuit is formed.

Figure 16C:
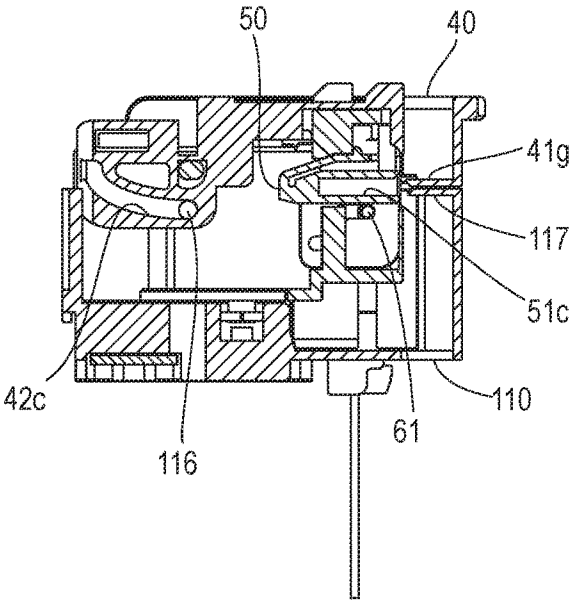
FIG. 16C is a cross-sectional view of FIG. 16A.
Figure 16B:
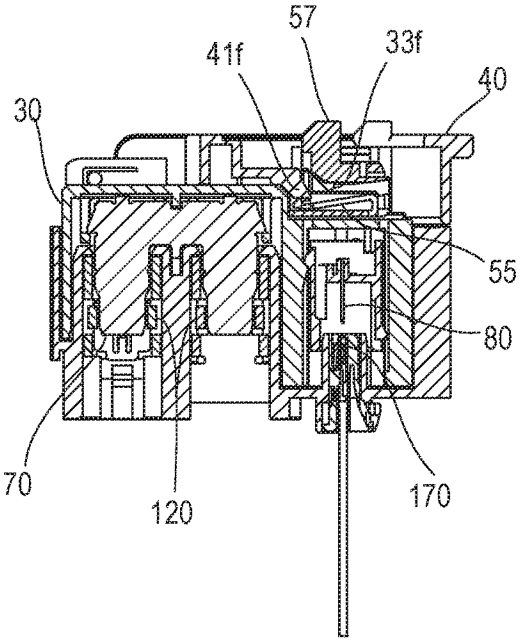
FIG. 16B is a cross-sectional view of FIG. 16A.
Figure 16A:
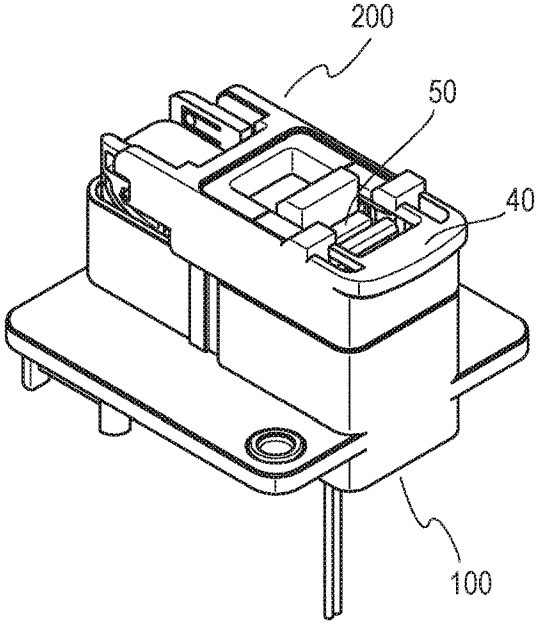
FIG. 16A is a perspective view showing a state where the lever is located at a closed position.

(3) As shown in FIGS. 16A to 16C, the lever 40 is further tilted. As shown in FIG. 16C, each boss 116 reaches an inner end of the cam groove 42*c*, and the lever 40 is located at a closed position. In a state where the lever 40 is located at the closed position, the projection 41*f* formed at the lever 40 hits the first locked piece 55 of the lock slider 50 to push the first locked piece 55, as shown in FIG. 16B. With this push, the first locked piece 55 locked by the locking portion 33*f* of the plug housing 30 is unlocked to enable the lock slider 50 to slide.

Figure 17C:
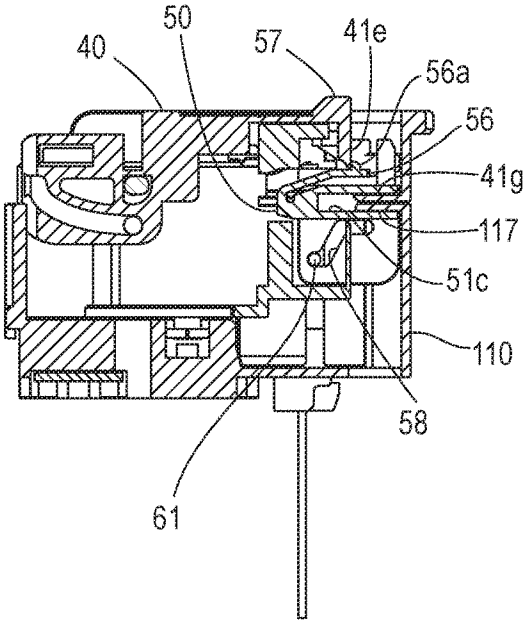
FIG. 17C is a cross-sectional view of FIG. 17A.
Figure 17B:
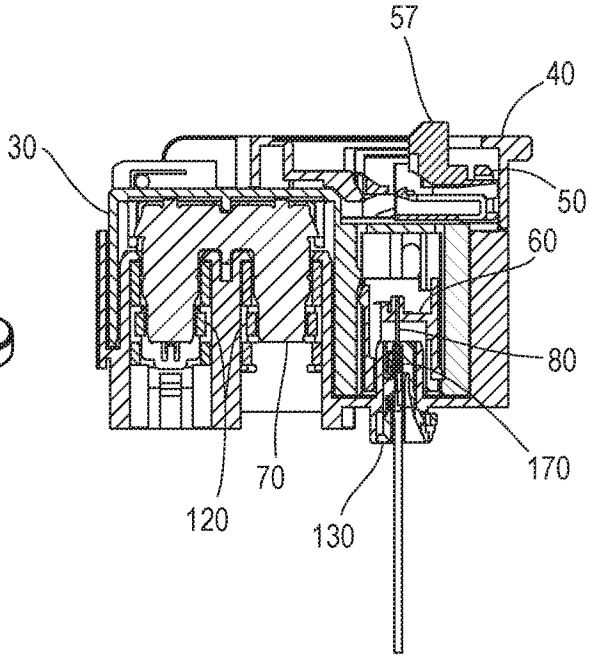
FIG. 17B is a cross-sectional view of FIG. 17A.
Figure 17A:
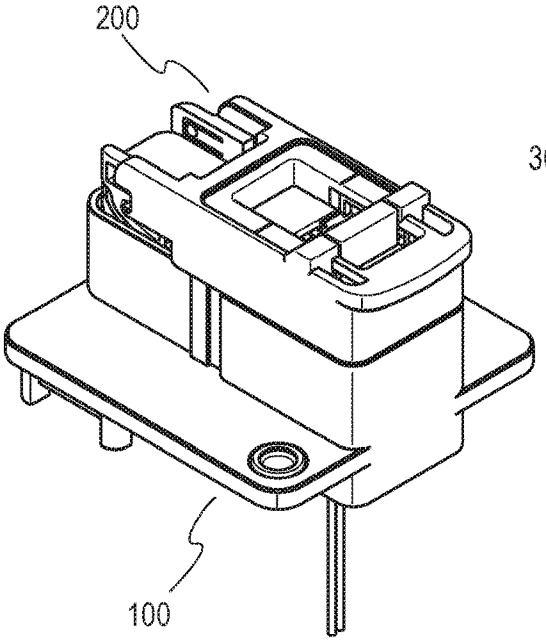
FIG. 17A is a perspective view showing a state where the lever is located at the closed position and the lock slider is at a connected position.

(4) Through a slide operation, the lock slider 50 moves from an unconnected position shown in FIGS. 16A to 16C to a connected position shown in FIGS. 17A to 17C. When the lock slider 50 slides, each boss 61 of the sub-connector 60 moves inside the cam groove 58 formed in the lock slider 50, and a cam mechanism including the cam grooves 58 and the bosses 61 causes the sub-connector 60 to move downward. With the movement of the sub-connector 60, the sub-terminal 80 attached to the sub-connector 60 is connected to the one pair of signal terminals 170 held by the connector 130 of the receptacle 100, as shown in FIG. 17B. The connection of the one pair of signal terminals 170 to the sub-terminal 80 turns on a switch of the power circuit, and energization starts.

Note that, in a state where the lock slider 50 is located at the connected position, the lug 56*a* of each second locked piece 56 of the lock slider 50 catches on the locking portion 41*e* of the lever 40, and the second locked piece 56 is locked onto the locking portion 41*e*, as shown in FIG. 17C. This prevents the lock slider 50 from moving from the connected position.

When the lock slider 50 slides from the unconnected position to the connected position, the regulating piece 117 of the receptacle housing 110 and the regulating piece 41*g* of the lever 40 enter into each groove 51*c* of the lock slider 50, as shown in FIG. 17C. This prevents the lever 40 from tilting.

Removal of the plug 200 from the receptacle 100 will be described.

Each second locked piece 56 of the lock slider 50 locked by the locking portion 41*e* of the lever 40 can be unlocked by pushing the button 57 of the lock slider 50. Thus, if the lock slider 50 is slide-operated while the button 57 is pushed, the lock slider 50 can move from the connected position shown in FIGS. 17A to 17C to the unconnected position shown in FIGS. 16A to 16C. With this movement, the sub-terminal 80 moves away from the one pair of signal terminals 170, and the switch of the power circuit is turned off to stop energization. The sub-terminal 80 functions to start energization when connected to the one pair of signal terminals 170 and functions to stop energization when separated from the one pair of signal terminals 170.

Figure 18B:
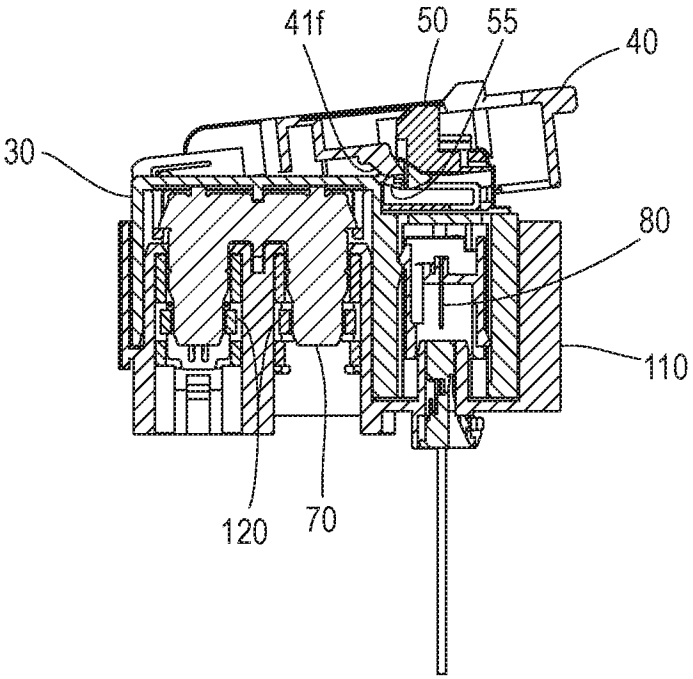
FIG. 18B is a cross-sectional view of FIG. 18A.
Figure 18A:
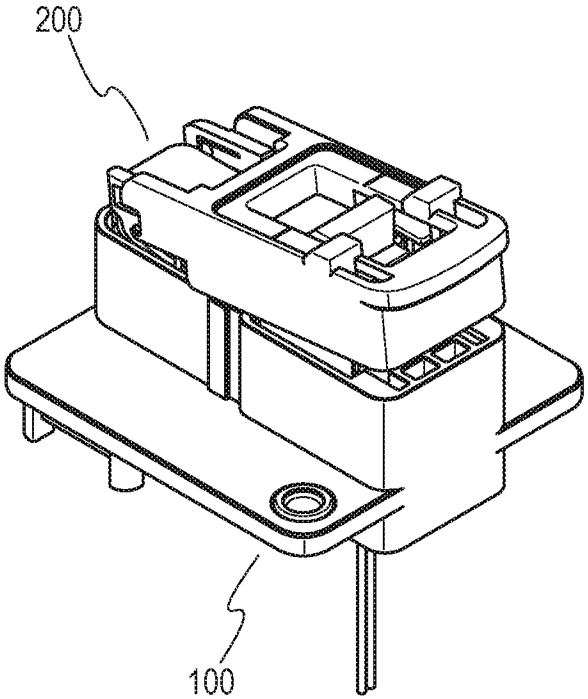
FIG. 18A is a perspective view showing a state where a force pushing the lever ceases and the lever floats up.

Since the regulating pieces 41*g* of the lever 40 come off from the grooves 51*c* of the lock slider 50, the lever 40 becomes tiltable. At this time, the lever 40 is subjected to a reaction force from the first locked piece 55 of the lock slider 50. In a state where a worker is out of contact with the lever 40 and the lever 40 is under no load, the lever 40 is not located at the closed position, and a distal end of the lever 40 floats up, as shown in FIGS. 18A and 18B. From this floating, a user can visually confirm that the sub-terminal 80 is away from the one pair of signal terminals 170 and that energization is suspended.

The lever 40 is tilted to the open position shown in FIGS. 14A and 14B. With this tilting, the main terminal 70 moves away from the one pair of power terminals 120 to break the power circuit. The plug 200 can be removed from the receptacle 100.

As has been described above, in the above-described example, the lever 40 cannot be tilted in a state where the lock slider 50 is located at the connected position and energization is going on. That is, the example is structured such that the power circuit cannot be broken by tilting the lever 40 unless energization is stopped by sliding the lock slider 50 to the unconnected position. It is thus possible to secure a discharge time between stoppage of energization and breaking of the power circuit.

The lock slider 50 that moves the sub-connector 60 holding the sub-terminal 80 is attached not to the lever 40 that is tilted but to the plug housing 30. For this reason, the lock slider 50 is not affected by looseness of the lever 40. This improves the accuracy of alignment of the sub-terminal 80 with the one pair of signal terminals 170. That is, occurrence of the problem of failure of the sub-terminal 80 to be satisfactorily connected to the one pair of signal terminals 170 is prevented.

Connection of the sub-terminal 80 to the one pair of signal terminals and separation of the sub-terminal 80 from the one pair of signal terminals are both satisfactorily performed. This improves an operation feel when the lock slider 50 is operated.

In the above-described embodiment, the plug housing 30 moves by the first cam mechanism including the cam grooves 42*c* provided in the lever 40 and the bosses 116 provided in the receptacle housing 110. However, a configuration, in which cam grooves are provided in the receptacle housing 110 and bosses to move inside the cam grooves are provided in the lever 40, may be adopted.

In the above-described embodiment, the sub-connector 60 moves by the second cam mechanism including the cam grooves 58 provided in the lock slider 50 and the bosses 61 provided in the sub-connector 60. However, a configuration, in which cam grooves are provided in the sub-connector 60 and bosses to move inside the cam grooves are provided in the lock slider 50, may be adopted.

In the above-described embodiment, the first locked piece 55 is provided at the lock slider 50, and the locking portion 33*f*, onto which the first locked piece 55 is to be locked, is provided at the plug housing 30. When the lever 40 is not located at the closed position, the first locked piece 55 is locked onto the locking portion 33*f*, which disables the lock slider 50 to slide and fixes the lock slider 50 to the unconnected position. However, a configuration may be adopted, in which a first locked piece is provided at the plug housing 30 and a locking portion (first locking portion), onto which the first locked piece is locked, is provided at the lock slider 50. In this case, the projection 41*f* of the lever 40 moves the first locked piece of the plug housing 30.

A structure for regulating a tilt of the lever 40 when the lock slider 50 is located at the connected position is not limited to the above-described example. For example, a structure may be adopted, in which a locked piece for tilt regulation is provided at the lever 40, the locked piece of the lever 40 is locked onto the receptacle housing 110 to disable tilting when the lock slider 50 is located at the connected position, and the locked piece of the lever 40 is unlocked to enable tilting of the lever 40 when the lock slider 50 is located at the unconnected position.

The foregoing description of the embodiment of the invention has been presented for the purpose of illustration and description. It is not intended to be exhaustive and to limit the invention to the precise form disclosed. Modifications or variations are possible in light of the above teaching. The embodiment was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A power-circuit breaking device comprising:

a receptacle; and a plug, wherein the receptacle includes one pair of power terminals and one pair of signal terminals inside a receptacle housing, the plug includes a plug housing, a main terminal, a sub-terminal, a lever, a lock slider, and a sub-connector, the lever is attached to the plug housing, the lever is tiltable in a direction toward the plug housing and in a direction away from the plug housing between an open position and a closed position, the lock slider is attached to the plug housing, the lock slider is slidable along the plug housing between an unconnected position and a connected position when the lever is located at the closed position, the sub-connector is stored in the plug housing while being supported by the lock slider, the sub-connector is movable inside the plug housing, the main terminal is held by the plug housing, the sub-terminal is held by the sub-connector, the plug is insertable into the receptacle and is removable from the receptacle when the lever is located at the open position, the plug enters into the plug housing when the lever tilts in the direction toward the plug housing while the plug is inserted in the receptacle, the lock slider is located at the unconnected position when the lever is not located at the closed position, the sub-connector moves when the lock slider slides, when the plug is inserted in the receptacle and the lever is located at the closed position, the main terminal is connected to the one pair of power terminals, and when the lever is located at the closed position and the lock slider is located at the connected position, the sub-terminal is connected to the one pair of signal terminals.

2. The power-circuit breaking device according to claim 1, wherein a first cam groove is formed in one of the lever and the receptacle housing, a first boss is formed at an other of the lever and the receptacle housing, and the plug housing moves by a first cam mechanism which includes the first cam groove and the first boss that moves inside the first cam groove when the lever tilts.

3. The power-circuit breaking device according to claim 1, wherein a second cam groove is formed in one of the lock slider and the sub-connector, a second boss is formed at an other of the lock slider and the sub-connector, and the sub-connector moves by a second cam mechanism which includes the second cam groove and the second boss that moves inside the second cam groove when the lock slider slides.

4. The power-circuit breaking device according to claim 1, wherein a first locked piece is formed at one of the lock slider and the plug housing, a first locking portion, onto which the first locked piece is to be locked, is formed at an other of the lock slider and the plug housing, the first locked piece is locked onto the first locking portion to disable the lock slider to slide from the unconnected position when the lever is not located at the closed position, and when the lever is located at the closed position, the first locked piece is pushed by a projection to unlock the first locked piece locked by the first locking portion, the projection being formed at the lever.

5. The power-circuit breaking device according to claim 4, wherein while the lever is subject to no force and the projection is in contact with the first locked piece, the lever is not located at the closed position.

6. The power-circuit breaking device according to claim 1, wherein a second locked piece is formed at the lock slider, a second locking portion which locks the second locked piece is formed at the lever, the second locked piece and a button are integrally formed, the second locked piece is locked onto the second locking portion to disable the lock slider to slide from the connected position when the lock slider is located at the connected position, and the second locked piece locked by the second locking portion is unlocked when the button is pushed.

7. The power-circuit breaking device according to claim 1, wherein the lever and the receptacle housing each have a regulating piece, a groove is formed in the lock slider, and the regulating pieces fit in the groove to disable the lever to tilt when the lock slider is located at the connected position.

8. The power-circuit breaking device according to claim 1, wherein a positioning piece is formed at one of the lever and the plug housing, a slit which positions the positioning piece is formed at an other of the lever and the plug housing, and the positioning piece is located in the slit to maintain the lever at the open position when the lever is located at the open position.

9. The power-circuit breaking device according to claim 1, wherein a first locked piece is formed at one of the lock slider and the plug housing, a first locking portion, onto which the first locked piece is to be locked, is formed at an other of the lock slider and the plug housing, the first locked piece is locked onto the first locking portion to disable the lock slider to slide from the unconnected position when the lever is not located at the closed position, when the lever is located at the closed position, the first locked piece is pushed by a projection to unlock the first locked piece locked by the first locking portion, the projection being formed at the lever, a second locked piece is formed at the lock slider, a second locking portion which locks the second locked piece is formed at the lever, the second locked piece and a button are integrally formed, the second locked piece is locked onto the second locking portion to disable the lock slider to slide from the connected position when the lock slider is located at the connected position, and the second locked piece locked by the second locking portion is unlocked when the button is pushed.

10. The power-circuit breaking device according to claim 9, wherein while the lever is subject to no force and the projection is in contact with the first locked piece, the lever is not located at the closed position.

11. The power-circuit breaking device according to claim 1, wherein a second locked piece is formed at the lock slider, a second locking portion which locks the second locked piece is formed at the lever, the second locked piece and a button are integrally formed, the second locked piece is locked onto the second locking portion to disable the lock slider to slide from the connected position when the lock slider is located at the connected position, the second locked piece locked by the second locking portion is unlocked when the button is pushed, the lever and the receptacle housing each have a regulating piece, a groove is formed in the lock slider, and the regulating pieces fit in the groove to disable the lever to tilt when the lock slider is located at the connected position.

12. The power-circuit breaking device according to claim 1, wherein a first locked piece is formed at one of the lock slider and the plug housing, a first locking portion, onto which the first locked piece is to be locked, is formed at an other of the lock slider and the plug housing, the first locked piece is locked onto the first locking portion to disable the lock slider to slide from the unconnected position when the lever is not located at the closed position, when the lever is located at the closed position, the first locked piece is pushed by a projection to unlock the first locked piece locked by the first locking portion, the projection being formed at the lever, the lever and the receptacle housing each have a regulating piece, a groove is formed in the lock slider, and the regulating pieces fit in the groove to disable the lever to tilt when the lock slider is located at the connected position.

13. The power-circuit breaking device according to claim 12, wherein while the lever is subject to no force and the projection is in contact with the first locked piece, the lever is not located at the closed position.

14. The power-circuit breaking device according to claim 1, wherein a first locked piece is formed at one of the lock slider and the plug housing, a first locking portion, onto which the first locked piece is to be locked, is formed at an other of the lock slider and the plug housing, the first locked piece is locked onto the first locking portion to disable the lock slider to slide from the unconnected position when the lever is not located at the closed position, when the lever is located at the closed position, the first locked piece is pushed by a projection to unlock the first locked piece locked by the first locking portion, the projection being formed at the lever, a second locked piece is formed at the lock slider, a second locking portion which locks the second locked piece is formed at the lever, the second locked piece and a button are integrally formed, the second locked piece is locked onto the second locking portion to disable the lock slider to slide from the connected position when the lock slider is located at the connected position, the second locked piece locked by the second locking portion is unlocked when the button is pushed, the lever and the receptacle housing each have a regulating piece, a groove is formed in the lock slider, and the regulating pieces fit in the groove to disable the lever to tilt when the lock slider is located at the connected position.

15. The power-circuit breaking device according to claim 14, wherein while the lever is subject to no force and the projection is in contact with the first locked piece, the lever is not located at the closed position.

16. The power-circuit breaking device according to claim 1, wherein a first cam groove is formed in one of the lever and the receptacle housing, a first boss is formed at an other of the lever and the receptacle housing, the plug housing moves by a first cam mechanism which includes the first cam groove and the first boss that moves inside the first cam groove when the lever tilts, a positioning piece is formed at one of the lever and the plug housing, a slit which positions the positioning piece is formed at an other of the lever and the plug housing, and the positioning piece is located in the slit to maintain the lever at the open position when the lever is located at the open position.

17. The power-circuit breaking device according to claim 1, wherein a first locked piece is formed at one of the lock slider and the plug housing, a first locking portion, onto which the first locked piece is to be locked, is formed at an other of the lock slider and the plug housing, the first locked piece is locked onto the first locking portion to disable the lock slider to slide from the unconnected position when the lever is not located at the closed position, when the lever is located at the closed position, the first locked piece is pushed by a projection to unlock the first locked piece locked by the first locking portion, the projection being formed at the lever, a positioning piece is formed at one of the lever and the plug housing, a slit which positions the positioning piece is formed at an other of the lever and the plug housing, and the positioning piece is located in the slit to maintain the lever at the open position when the lever is located at the open position.

* * * * *